United States Patent [19]

Kojima et al.

[11] 4,455,368

[45] Jun. 19, 1984

[54] SILVER HALIDE PHOTOGRAPHIC LIGHT-SENSITIVE MATERIAL CONTAINING A UV ABSORBING POLYMER LATEX

[75] Inventors: Tetsuro Kojima; Shingo Ishimaru; Naohiko Sugimoto; Tadashi Ikeda, all of Kanagawa, Japan

[73] Assignee: Fuji Photo Film Co., Ltd., Kanagawa, Japan

[21] Appl. No.: 484,813

[22] Filed: Apr. 14, 1983

[30] Foreign Application Priority Data

Apr. 16, 1982 [JP] Japan ..... 57-63602

[51] Int. Cl.[3] ..... G03C 1/78

[52] U.S. Cl. ..... 430/507; 430/512; 430/523; 430/627; 430/931; 526/280; 526/288; 526/292.2; 526/298; 526/301; 526/304; 526/313

[58] Field of Search ..... 430/512, 627, 931, 503, 430/507, 523

[56] References Cited

U.S. PATENT DOCUMENTS

| | | | |
|---|---|---|---|
| 4,045,229 | 8/1977 | Weber et al. | 430/512 |
| 4,195,999 | 4/1980 | Adachi et al. | 430/512 |
| 4,307,184 | 12/1981 | Beretta et al. | 430/512 |

*Primary Examiner*—Jack P. Brammer

*Attorney, Agent, or Firm*—Sughrue, Mion, Zinn, Macpeak, and Seas

[57] ABSTRACT

A silver halide photographic light-sensitive material comprising a support having thereon at least one light-sensitive silver halide emulsion and at least one light-insensitive layer is disclosed. One or more of the layers of the material contains an ultraviolet ray absorbing polymer latex which comprises a homopolymer or copolymer having a repeating unit derived from a monomer represented by the general formula (II) in which one or more ultraviolet ray absorbing compounds represented by the general formula (I) is loaded:

(I)

(II)

the substituents within the general formula are defined within the specification. The material has excellent absorption characteristics in the 300 to 400 nm range and does not cause static marks caused by ultraviolet rays or undergo deterioration of color reproduction. In addition, the material has good film strength and reduced layer thickness and provides a color image having improved sharpness which is free from fading or discoloration due to light.

28 Claims, 8 Drawing Figures

SILVER HALIDE PHOTOGRAPHIC LIGHT-SENSITIVE MATERIAL CONTAINING A UV ABSORBING POLYMER LATEX

FIELD OF THE INVENTION

The present invention relates to a silver halide photographic light-sensitive material and, particularly, to a process for preventing bad influences created by ultraviolet rays which comprises incorporating an ultraviolet ray absorbing polymer latex in a silver halide photographic light-sensitive material and to a silver halide photographic light-sensitive material wherein such an influence is prevented.

BACKGROUND OF THE INVENTION

It is well known that ultraviolet rays have a bad influence upon photographic light-sensitive materials. In photographic light-sensitive materials, a light-sensitive photographic emulsions containing silver halide as a chief component is generally applied to a support having a relatively high electrical insulating property such as a film composed of triacetyl cellulose, polyethylene terephthalate, polystyrene or polycarbonate, or a laminated paper covered therewith, and the surface of the photographic light-sensitive materials has a fairly high electrical insulating property. Therefore, when the surface of the photographic light-sensitive material comes in contact with the same or different kind of material during production or treatment of the photographic light-sensitive material, electric charges are generated by friction or separation. This phenomenon is called charging. When accumulation of static electricity by charging reaches a certain limiting value, atmospheric discharge occurs at a particular moment and a discharge spark flies at the same time. When the photographic light-sensitive material is exposed to light by discharging, branched, feathered, spotted or radial images appear after development. Images formed by such a phenomenon are called static marks in the photographic field. It has been known that a distribution of spectral energy of this kind of discharge luminescence which causes static marks is in a range of 200 nm to 550 nm and particularly the intensity thereof is high in a range of 300 nm to 400 nm, and light energy in this range causes occurrence of static marks. Accordingly, attempts have been made to prevent the occurrence of static marks by shielding ultraviolet rays in a range of 300 to 400 nm by means of ultraviolet ray absorbing agents, as described in, for example, Japanese Patent Publication No. 10726/75 (corresponding to British Pat. No. 1,378,000 and German Pat. No. 2,163,904), Japanese Patent Application (OPI) No. 26021/76 (corresponding to Belgian Pat. No. 832,793) (the term "OPI" as used herein refers to a "published unexamined Japanese patent application"), and French Pat. No. 2,036,679 (corresponding to Belgian Pat. No. 755,781), etc.

Further, excepting light-sensitive materials such as light-sensitive materials for printing which are exposed to a specific light source or light-sensitive materials for X-rays, etc., the conventional photographic light-sensitive materials are sometimes subject to an undesirable influence by ultraviolet rays included in light to be used for exposure. For example, in black-and-white light-sensitive materials, objects to be photographed which have a remarkably large quantity of spectral energy in an ultraviolet region, such as a snow scene, a seashore or the sky, etc., easily form soft tone images. In color light-sensitive materials, since it is desired to record only visible light, the influence of ultraviolet rays is very apparent. For example, when photographing objects which have a comparatively large quantity of spectral energy in the ultraviolet region, such as a distant view, a snow scene or an asphalted road, etc., the resulting color images are rich in cyan color. Further, color reproduction in color images is notably different according to light sources to be used for exposure, such as the sun, a tungsten lamp or a fluorescent lamp, etc. The cause of the difference is a difference of spectral energy in the ultraviolet region of light from these light sources. Namely, color images obtained by being exposed to light emitted from a tungsten lamp become more reddish and those obtained by being exposed to light emitted from a fluorescent lamp become more bluish than those obtained by being exposed to sunlight. Accordingly, in order to obtain color photographic images which have correct color reproduction, it is desirable to prevent ultraviolet rays from reaching the silver halide light-sensitive layer of the color light-sensitive material when photographing. Examples of attempts at such have been described in, for example, Japanese Patent Application (OPI) Nos. 56620/76 (corresponding to U.S. Pat. No. 4,045,229) and 49029/77 (corresponding to U.S. Pat. No. 4,200,464).

Furthermore, color photographs and, particularly, dye images formed on the light-sensitive emulsion layers by color development easily cause fading or discoloration of color images due to the action of ultraviolet rays. Color formers remaining in the emulsion layers after formation of color images are subject to the action of ultraviolet rays to form undesirable color stains on the finished photographs. This kind of action of ultraviolet rays on color photographic treatment is particularly remarkable with positive prints observed under sunlight containing a large quantity of ultraviolet rays. The fading and the discoloration of color images are easily caused by ultraviolet rays having wavelengths near the visible region, namely, those having spectral energy in the area of 300 to 400 nm. Examples of useful ultraviolet ray absorbing agents which act in reducing bad influences caused by these types of ultraviolet rays are described in U.S. Pat. Nos. 3,215,530, 3,707,375, 3,705,805, 3,352,681, 3,278,448, 3,253,921 and 3,738,837, Japanese Patent Publication Nos. 26138/74 and 25337/75, British Pat. No. 1,338,265 and Japanese Patent Application (OPI) No. 56620/76 (corresponding to U.S. Pat. No. 4,045,229), etc.

Hitherto, a number of ultraviolet ray absorbing agents have been proposed for one or more purposes as described above. However, ultraviolet ray absorbing agents used hitherto for silver halide photographic light-sensitive materials are not sufficiently suitable for the above described uses, because they color and form stains due to their insufficient stability to ultraviolet rays, heat and humidity. Further, they have inferior compatibility with binders, they diffuse into other layers causing bad influences due to substantial interlayer migration, or the emulsion thereof may be unstable causing deposition of crystals. Further, these ultraviolet ray absorbing agents have been frequently used in a protective layer of silver halide photographic light-sensitive materials, and when a high boiling point organic solvent is used for emulsification of the ultraviolet ray absorbing agents, the high boiling point organic solvent softens the layer and substantially deteriorate interlayer adhesion or antiadhesive property. In order to prevent such problems, it is necessary to use a large amount of gelatin or to provide a gelatin protective layer on the layer. This results in thickening the layer containing the ultraviolet ray absorbing agent, even though it is desirable to reduce the thickness of the layer.

It is known that polymer latexes obtained by polymerization of ultraviolet ray absorbing monomers are utilized for an ultraviolet ray absorbing agent which does not have such disadvantages.

Two processes for adding polymer ultraviolet ray absorbing agents in the form of latex to a hydrophilic colloid composition have been known. One process comprises adding a latex prepared by emulsion polymerization directly to a gelatin silver halide emulsion. Another process comprises dispersing a hydrphobic polymer ultraviolet ray absorbing agent obtained by polymerization of ultraviolet ray absorbing monomers in an aqueous solution of gelatin in the form of a latex. Such ultraviolet ray absorbing polymer latexes have been described in, for example, U.S. Pat. Nos. 3,761,272 and 3,745,010, Japanese Patent Application (OPI) No. 107835/78 and European Pat. No. 27242, etc.

The processes for adding the polymer ultraviolet ray absorbing agents in the form of a latex to a hydrophilic colloid composition have many advantages as compared with other processes.

First, it is not necessary to use a high boiling point organic solvent used hitherto, because a hydrophobic material is in the form of a latex, and thus the strength of the film formed from the latex is not deteriorated. Also, it is possible to easily incorporate the ultraviolet ray absorbing agent in a high concentration in the emulsion, because the latex can contain ultraviolet ray absorbing monomers in a high concentration, and any increase in viscosity is small. Further, other layers are not affected since they are completely immobilized, and deposition of the ultraviolet ray absorbing agents in the emulsion layer is small and the thickness of the emulsion layer can be reduced. Particularly, when an ultraviolet ray absorbing polymer latex is produced by emulsion polymerization a specific method for dispersing is not required and thus the step of adding the ultraviolet ray absorbing agent to the coating solution can be simplified. However, though the ultraviolet ray absorbing polymer latexes known hitherto have several excellent advantages as described above, they also have the following problems.

1. Since the absorption peak of the ultraviolet ray absorbing agent becomes broad, the color reproduction property is inferior.
2. The absorption characteristics in the range of 300 nm to 400 nm is poor.
3. Since the ultraviolet ray absorbing agent itself is not sufficiently stable to ultraviolet rays, heat and humidity, it colors and causes stains.
4. Ultraviolet ray absorbing monomers have low solubility and very poor polymerization ability.
5. It is necessary to add a large amount of the latex in order to obtain a desired density, because the ultraviolet ray absorbing monomers have a low absorption coefficient.

The broadening in the absorption peak of the ultraviolet ray absorbing agents having the absorption maximum in a range of about 360 nm to about 400 nm has a great influence upon the photographic properties. Such ultraviolet ray absorbing polymer latexes which absorb ultraviolet rays in the range of about 360 nm to about 400 nm are described in European Pat. No. 27242. However, these ultraviolet ray absorbing polymer latexes are still not sufficient since they have several disadvantages in that they have a bad influence upon the photographic properties, for example, the formation of stains or the decrease in the sensitivity of the silver halide emulsion due to the broadening in the absorption peak thereof, and in that the polymerization ability of the ultraviolet ray absorbing monomers used is very poor, etc.

SUMMARY OF THE INVENTION

Therefore, an object of the present invention is to provide a silver halide photographic light-sensitive material containing a novel ultraviolet ray absorbing polymer latex having an excellent absorption characteristic in the range of 300 nm to 400 nm which does not cause static marks, deterioration of color reproduction, and fading or discoloration of color images caused by ultraviolet rays.

Another object of the present invention is to provide a silver halide photographic light-sensitive material containing a novel ultraviolet ray absorbing polymer latex which does not have a bad influence by diffusion into other layers due to very small interlayer migration.

Still another object of the present invention is to provide a silver halide photographic light-sensitive material containing a novel ultraviolet ray absorbing polymer latex which is sufficiently stable to ultraviolet rays, heat and humidity.

A further object of the present invention is to provide a silver halide photographic light-sensitive material containing a novel ultraviolet ray absorbing polymer latex having high film strength which does not influence film properties such as adhesion.

A further object of the present invention is to provide a silver halide photographic light-sensitive material containing a novel ultraviolet ray absorbing polymer latex, wherein the layer thickness is small and the resulting images have improved sharpness.

A still further object of the present invention is to provide a silver halide photographic light-sensitive material containing a novel ultraviolet ray absorbing polymer latex which does not have a bad influence upon photographic properties such as sensitivity or fog, etc.

Other objects of the present invention will be apparent from the following detailed description and examples.

As a result of extensive investigations, it has now been found that these objects of the present invention are attained by using at least one ultraviolet ray absorbing compound represented by the general formula (I) described below which is loaded into an ultraviolet ray absorbing polymer latex composed of a homopolymer or a copolymer having a repeating unit derived from at least one monomer represented by the general formula (II) described below.

More specifically, it has been found that these objects can be attained by a silver halide photographic light-sensitive material comprising a support having thereon at least one light-sensitive silver halide emulsion layer and at least one light-insensitive layer, the photographic light-sensitive material containing, in the light-sensitive silver halide emulsion layer and/or the light-insensitive layer, an ultraviolet ray absorbing polymer latex which comprises a homopolymer or a copolymer having a repeating unit derived from at least one monomer represented by the following general formula (II) in which at least one ultraviolet ray absorbing compound represented by the following general formula (I) is loaded:

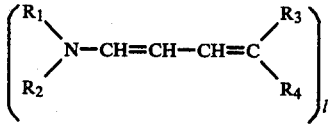

(I)

where l represents an integer of 1 or 2; and $R_1$ and $R_2$, which may be the same or different, each represents a hydrogen atom, an alkyl group having from 1 to 20 carbon atoms (for example, a methyl group, an ethyl group, an n-butyl group, an n-hexyl group, a cyclohexyl group, an n-decyl group, an n-dodecyl group, an n-octadecyl group, an eicosyl group, a methoxyethyl group, an ethoxypropyl group, a 2-ethylhexyl group, a hydroxyethyl group, a chloropropyl group, an N,N-diethylaminopropyl group, a cyanoethyl group, a phenethyl group, a benzyl group, a p-tert-butylphenethyl group, a p-tert-octylphenoxyethyl group, a 3-(2,4-di-tert-amylphenoxy)propyl group, an ethoxycarbonylmethyl group, a 2-(2-hydroxyethoxy)ethyl group, a 2-furylethyl group, etc.) or an aryl group having from 6 to 20 carbon atoms (for example, a tolyl group, a phenyl group, an anisyl group, a mesityl group, a chlorophenyl group, a 2,4-di-tert-amylphenyl group, a naphthyl group, etc.) provided that the both of $R_1$ and $R_2$ do not simultaneously represent hydrogen atoms, and further $R_1$ and $R_2$ may combine with each other to form an atomic group necessary to form a cyclic amino group (for example, a piperidino group, a morpholino group, a pyrrolidino group, a hexahydroazepino group, a piperazino group, etc.); $R_3$ represents a cyano group, $—COOR_5$, $—COR_5$ or $—SO_2R_5$; $R_4$ represents a cyano group, $—COOR_6$, $—COR_6$ or $—SO_2R_6$; and $R_5$ and $R_6$ each represents an alkyl group having from 1 to 20 carbon atoms or an aryl group having from 6 to 20 carbon atoms, each having the same meanings as an alkyl group or an aryl group for $R_1$ and $R_2$, and further $R_5$ and $R_6$ may combine with each other to form an atomic group necessary to form a 1,3-dioxocyclohexane ring (for example, a dimedone ring, a 1,3-dioxo-5,5-diethylcyclohexane ring, etc.), a 1,3-diaza-2,4,6-trioxocyclohexane ring (for example, a barbituric acid ring, a 1,3-dimethylbarbituric acid ring, a 1-phenylbarbituric acid ring, a 1-methyl-3-octylbarbituric acid ring, a 1-ethyl-3-octyl oxycarbonylethylbarbituric acid ring, etc.), a 1,2-diaza-3,5-dioxocyclopentane ring (for example, a 1,2-diaza-1,2-dimethyl-3,5-dioxocyclopentane ring, a 1,2-diaza-1,2-diphenyl-3,5-dioxocyclopentane ring, etc.) or a 2,4-diaza-1-alkoxy-3,5-dioxocyclohexene ring (for example, a 2,4-diaza-1-ethoxy-4-ethyl-3,5-dioxocyclohexene ring, a 2,4-diaza-1-ethoxy-4-[3-(2,4-di-tert-amylphenoxy)propyl]-3,5-dioxocyclohexene ring, etc.); and when l is 2, $R_1$, $R_2$ and $R_5$ each may further represent an alkylene group (for example, a methylene group, an ethylene group, a decamethylene group, etc.) or an arylene group (for example, a phenylene group, etc.), and at least one of $R_1$, $R_2$ and $R_5$ represents an alkylene group or an arylene group whereby the compound of the general formula (I) is a dimer;

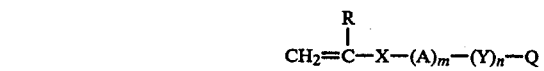

(II)

wherein R represents a hydrogen atom, a lower alkyl group having from 1 to 4 carbon atoms (for example, a methyl group, an ethyl group, an n-propyl group, an isopropyl group or an n-butyl group, etc.) or a chlorine atom; X represents —CONH—, —COO— or a phenylene group; A represents a linking group selected from an alkylene group having from 1 to 20 carbon atoms (for example, a methylene group, an ethylene group, a trimethylene group, a 2-hydroxytrimethylene group, a pentamethylene group, a hexamethylene group, an ethylethylene group, a propylene group or a decamethylene group, etc.) or an arylene group having from 6 to 20 carbon atoms (for example, a phenylene group, etc.); Y represents —COO—, —OCO—, —CONH—, —NHCO—, $—SO_2NH—$, $—NHSO_2—$, $—SO_2—$ or —O—; m represents 0 or an integer of 1; n represents 0 or an integer of 1; and Q represents an ultraviolet ray absorbing group represented by the following general formula (III):

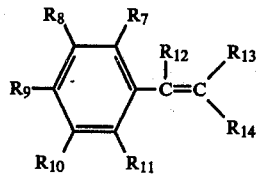

(III)

wherein $R_7$, $R_8$, $R_9$, $R_{10}$ and $R_{11}$, which may be the same or different, each represents a hydrogen atom, a halogen atom (for example, a chlorine atom or a bromine atom, etc.), an alkyl group having from 1 to 20 carbon atoms (for example, a methyl group, an ethyl group, an n-propyl group, an isopropyl group, an n-butyl group, a tert-butyl group, an n-amyl group, a tert-amyl group, an n-octyl group, a tert-octyl group, a methoxyethyl group, an ethoxypropyl group, a hydroxyethyl group, a chloropropyl group, a benzyl group or a cyanoethyl group, etc.), an aryl group having from 6 to 20 carbon atoms (for example, a phenyl group, a tolyl group, a mesityl group, a chlorophenyl group, etc.), an alkoxy group having from 1 to 20 carbon atoms (for example, a methoxy group, an ethoxy group, a propoxy group, a butoxy group, an octyloxy group, a 2-ethylhexyloxy group, a methoxymethoxy group, a methoxyethoxy group or an ethoxyethoxy group, etc.), an aryloxy group having from 6 to 20 carbon atoms (for example, a phenoxy group or a 4-methylphenoxy group, etc.), an alkylthio group having from 1 to 20 carbon atoms (for example, a methylthio group, an ethylthio group, a propylthio group or an n-octylthio group, etc.), an arylthio group having from 6 to 20 carbon atoms (for example, a phenylthio group, etc.), an amino group, an alkylamino group having from 1 to 20 carbon atoms (for example, a methylamino group, an ethylamino group, a benzylamino group, a dimethylamino group or a diethylamino group, etc.), an arylamino group having from 6 to 20 carbon atoms (for example, an anilino group, a diphenylamino group, an anisidino group or a toluidino group, etc.), a hydroxy group, a cyano group, a nitro group, an acylamino group (for example, an acetylamino group, etc.), a carbamoyl group (for example, a methylcarbamoyl group or a dimethylcarbamoyl group, etc.), a sulfonyl group (for example, a methylsulfonyl group or a phenylsulfonyl group, etc.), a sulfamoyl group (for example, an ethylsulfamoyl group or a dimethylsulfamoyl group, etc.), a sulfonamido group (for example, a methanesulfonamido group, etc.), an acyloxy group (for example, an acetoxy group or a benzoyloxy group, etc.) or an oxycarbonyl group (for example, a methoxycarbonyl group, an ethoxycarbonyl group or a phenoxycarbonyl group, etc.), and $R_7$ and $R_8$, $R_8$ and $R_9$, $R_9$ and $R_{10}$ or $R_{10}$ and $R_{11}$ may form a 5- or 6-membered ring by ring closure (for example, a methylenedioxy group, etc.); $R_{12}$ represents a hydrogen atom, an alkyl group having from 1 to 20 carbon atoms (for example, a methyl group, an ethyl group, an n-propyl group, an isopropyl group, an n-butyl group, an n-amyl group or an n-octyl group, etc.) or an aryl group having from 6 to 20 carbon atoms; $R_{13}$ represents a cyano group, —$COOR_{15}$, —$CONHR_{15}$, —$COR_{15}$, or —$SO_2R_{15}$; $R_4$ represents a cyano group, —$COOR_{16}$, —$CONHR_{16}$, —$COR_{16}$ or —$SO_2R_{16}$; and $R_{15}$ $R_{16}$ each represents the same alkyl group or aryl group as described above. Further, at least one of $R_7$, $R_8$, $R_9$, $R_{10}$, $R_{11}$, $R_{12}$, $R_{13}$ and $R_{14}$ bonds to the vinyl group through the above-described linking group.

DETAILED DESCRIPTION OF THE INVENTION

Figure 1B:
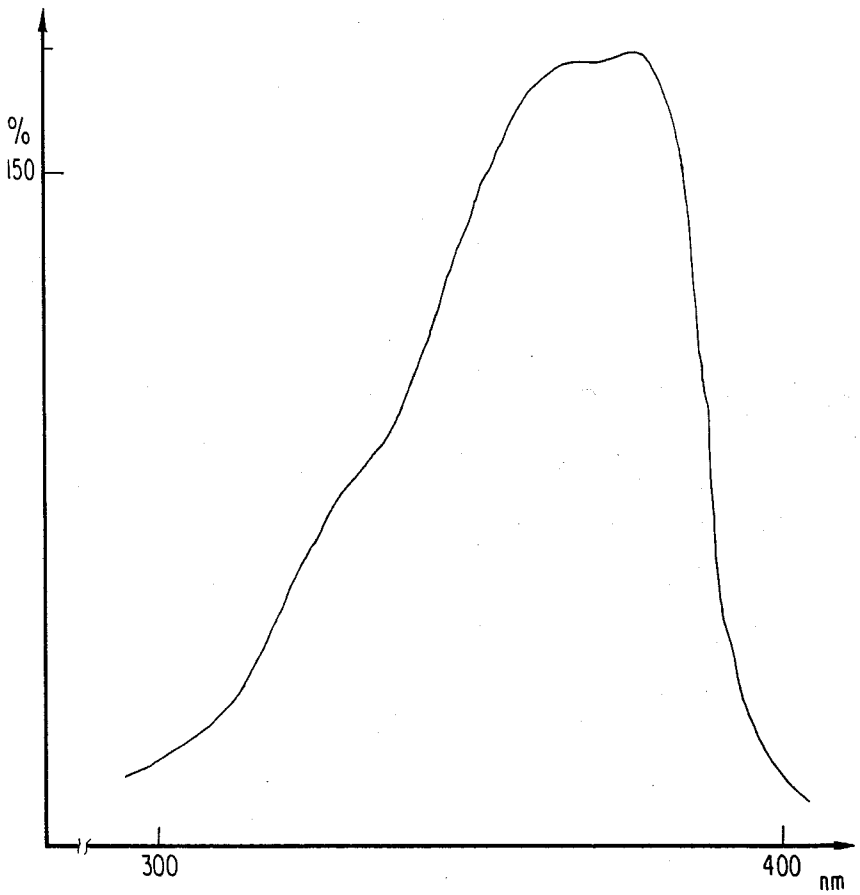
FIGS. 1 (a), (b), (c), (d) and (e)
Figure 1A:
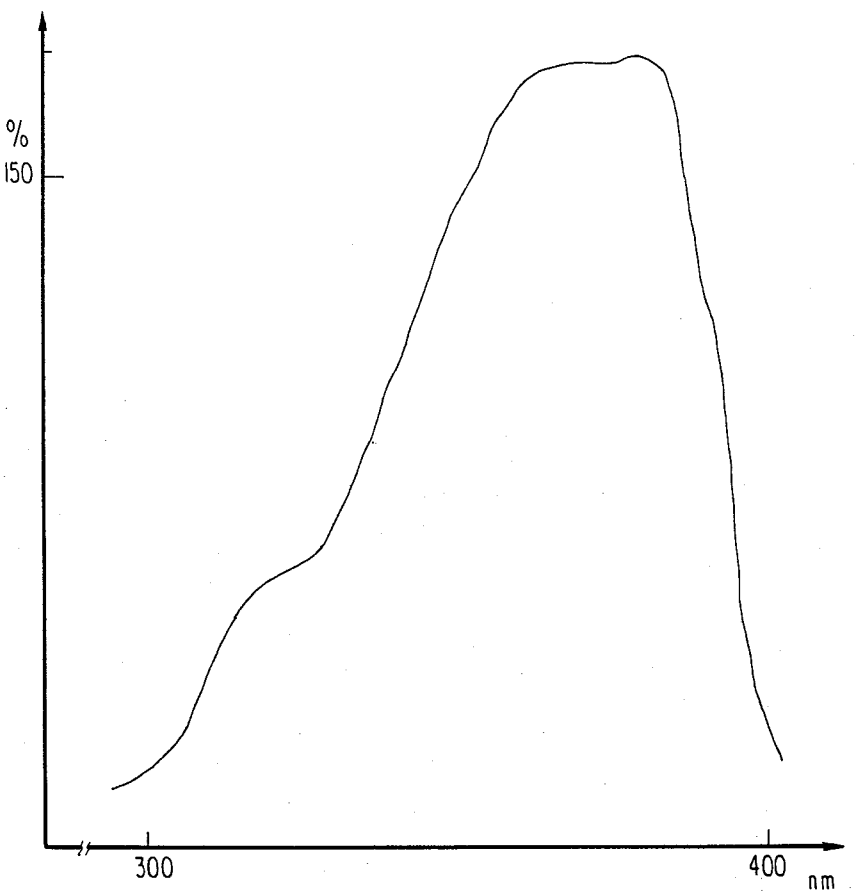
Figure 1D:
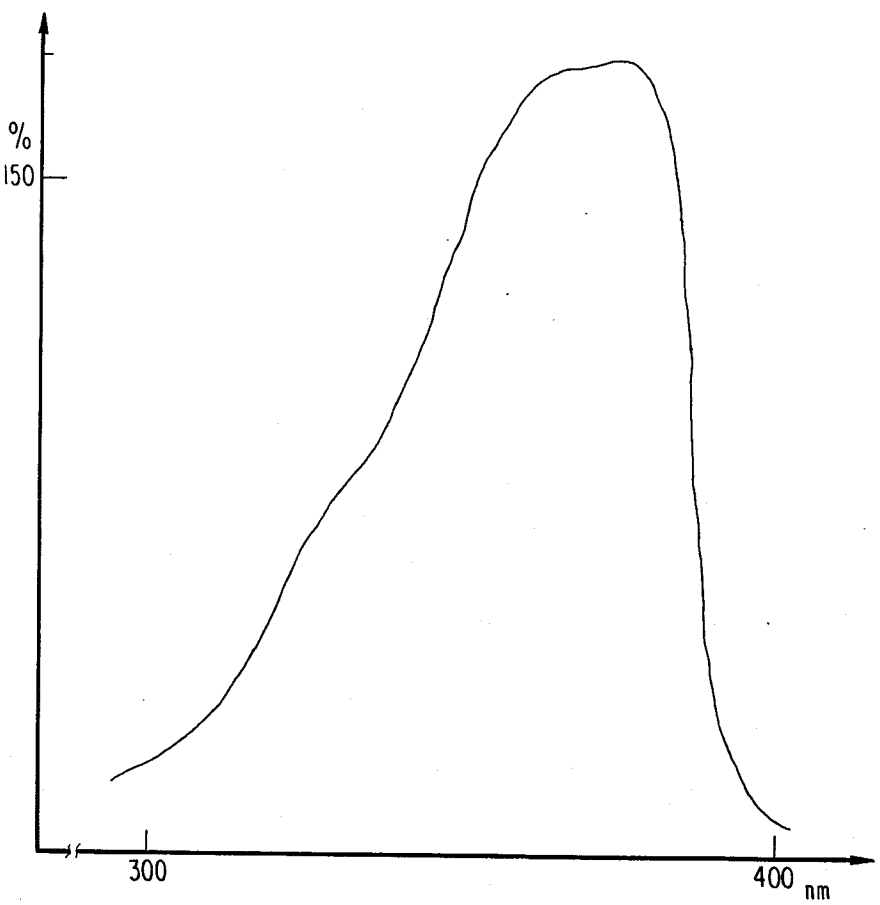
Figure 1C:
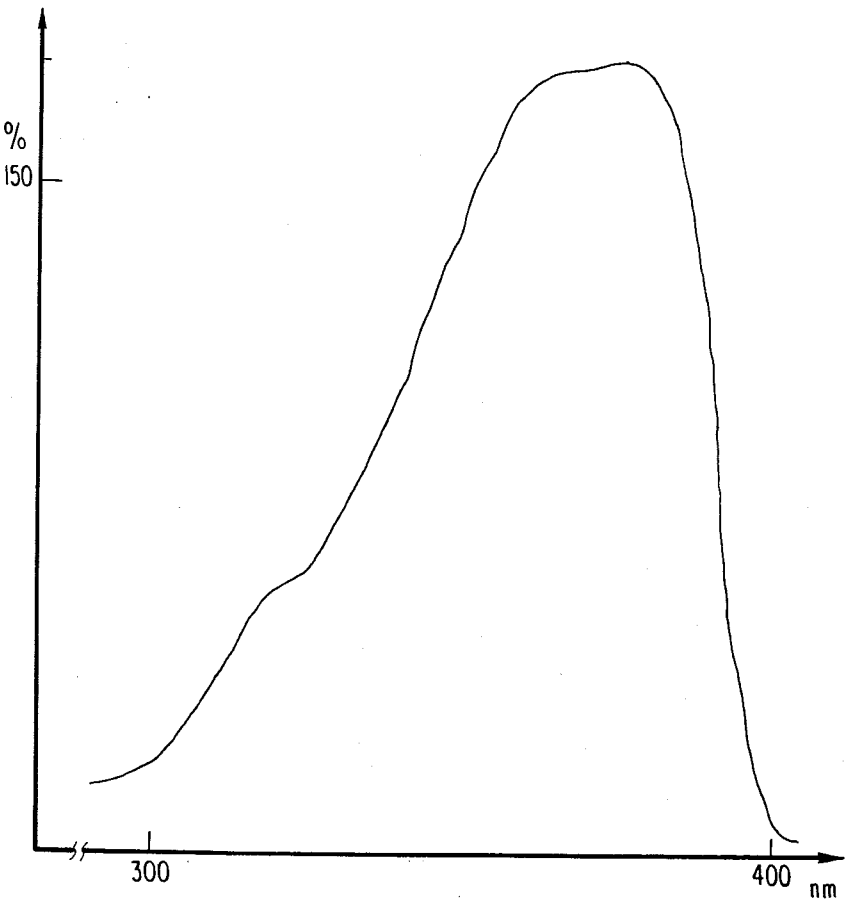

Of the compounds represented by the general formula (I), those wherein l represents 1, $R_1$ and $R_2$ each represents an alkyl group having from 1 to 20 carbon atoms, $R_3$ represents a cyano group or —$SO_2R_5$, $R_4$ represents a cyano group or —$COOR_6$, and $R_5$ and $R_6$ each represents an alkyl group having from 1 to 20 carbon atoms or an aryl group having from 6 to 20 carbon atoms are preferred.

Of the compounds represented by the general formula (II), those wherein R represents a hydrogen atom, a lower alkyl group having from 1 to 4 carbon atoms or a chlorine atom, X represents —CONH—, —COO— or a phenylene group, A represents a linking group represented by an alkylene group having from 1 to 20 carbon atoms or an arylene group having from 6 to 20 carbon atoms, Y represents —COO—, —OCO—, —CONH—, —NHCO— or —O—, m represents 0 or an integer of 1, represents 0 or an integer of 1, and Q represents an ultraviolet ray absorbing group represented by the general formula (III) wherein $R_7$, $R_8$, $R_9$, $R_{10}$ and $R_{11}$ each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylamino group having from 1 to 20 carbon atoms, an arylamino group having from 6 to 20 carbon atoms, a hydroxy group, an acylamino group, a carbamoyl group, an acyloxy group or an oxycarbonyl group, and $R_7$ and $R_8$, $R_8$ and $R_9$, $R_9$ and $R_{10}$ or $R_{10}$ and $R_{11}$ may form a 5- or 6-membered ring by ring closure, $R_{12}$ represents a hydrogen atom or an alkyl group having from 1 to 20 carbon atoms, $R_{13}$ represents a cyano group, —$COOR_{15}$, —$CONHR_{15}$, —$COR_{15}$ or —$SO_2R_{15}$, $R_{14}$ represents a cyano group, —$COOR_{16}$, —$CONHR_{16}$, —$COR_{16}$ or —$SO_2R_{16}$, and $R_{15}$ and $R_{16}$ each represents an alkyl group having from 1 to 20 carbon atoms or an aryl group having from 6 to 20 carbon atoms, and further, at least one of $R_7$, $R_8$, $R_9$, $R_{10}$, $R_{11}$, $R_{12}$, $R_{13}$ and $R_{14}$ bonds to the vinyl group through the above-described linking group are preferred.

Of the compounds represented by the general formula (I), those wherein l represents 1, $R_1$ and $R_2$ each represents an alkyl group having from 1 to 6 carbon atoms, $R_3$ represents —$SO_2R_5$, $R_4$ represents —$COOR_6$, $R_5$ represents a phenyl group which may be substituted (for example, a phenyl group, a tolyl group, etc.), and $R_6$ represents an alkyl group having from 1 to 20 carbon atoms are particularly preferred.

Preferred compounds represented by the general formula (II) include those wherein R represents a hydrogen atom, a lower alkyl group having from 1 to 4 carbon atoms or a chlorine atom, X represents —COO—, m represents 0, n represents 0, Q represents an ultraviolet ray absorbing group represented by the general formula (III) wherein $R_7$, $R_8$, $R_{10}$ and $R_{11}$ each represents a hydrogen atom, $R_9$ represents a hydrogen atom or an alkyl group having from 1 to 5 carbon atoms, $R_{12}$ represents a hydrogen atom, $R_{13}$ represents a cyano group, $R_{14}$ represents —$COOR_{16}$, and $R_{16}$ represents an alkylene group having 1 to 20 carbon atoms which bonds to the vinyl group.

Examples of monomers (comonomers) used for copolymerizing with the ultraviolet ray absorbing monomer include an ester, preferably a lower alkyl ester, and an amide, derived from an acrylic acid, for example, acrylic acid, α-chloroacrylic acid, an α-alkylacrylic acid such as methacrylic acid, etc. (for example, acrylamide, methacrylamide, tert-butylacrylamide, methyl acrylate, methyl methacrylate, ethyl acrylate, ethyl methacrylate, n-propyl acrylate, n-butyl acrylate, 2-ethylhexyl acrylate, n-hexyl acrylate, octyl methacrylate, lauryl methacrylate and methylenebisacrylamide, etc.), a vinyl ester (for example, vinyl acetate, vinyl propionate and vinyl laurate, etc.), acrylonitrile, methacrylonitrile, an aromatic vinyl compound (for example, styrene and a derivative thereof such as vinyl toluene, divinylbenzene, vinylacetophenone, sulfostyrene and styrenesulfinic acid, etc.), itaconic acid, citraconic acid, crotonic acid, vinylidene chloride, a vinyl alkyl ether (for example, vinyl ethyl ether, etc.), an eater of maleic acid, N-vinyl-2-pyrrolidone, N-vinylpyridine and 2- and 4-vinylpyridine, etc.

It is preferred that the amount of the comonomer portion in the ultraviolet ray absorbing polymer latex according to the present invention is generally from 0% to 95% by weight, and an amount of from 0% to 50% by weight is particularly preferred.

Of these monomers, an ester of acrylic acid, an ester of methacrylic acid and an aromatic vinyl compound are particularly preferred.

Two or more of the above-described comonomer compounds may be used together. For example, it is possible to use a combination of n-butyl acrylate and divinylbenzene, styrene and methyl methacrylate, methyl acrylate and methacrylic acid, etc.

The ethylenically unsaturated monomer which is used to copolymerize with the ultraviolet ray absorbing monomer corresponding to the above-described general formula (II) can be selected so as to have a good influence upon physical properties and/or chemical properties of the copolymer to be prepared, for example, solubility, compatibility with a binder such as gelatin in the photographic colloid composition or other photographic additives, for example, known photographic ultraviolet ray absorbing agents, known photographic anti-oxidants and known color image forming agents, flexibility and thermal stability thereof, etc.

The ultraviolet ray absorbing polymer latex used in the present invention may be prepared by an emulsion polymerization method as described above or may be prepared by dissolving a hydrophobic polymer ultraviolet ray absorbing agent obtained by polymerization of an ultraviolet ray absorbing monomer in an organic solvent and then dispersing the solution in a latex form in an aqueous solution of gelatin.

These methods can be applied to the preparation of homopolymers and formation of copolymers. In the latter case, the comonomer is preferably liquid at room temperature, because it functions as a solvent for the ultraviolet ray absorbing monomer which is solid in a normal state when carrying out emulsion polymerization.

Free radical polymerization of an ethylenically unsaturated solid monomer is initiated with the addition of a free radical which is formed by thermal decomposition of a chemical initiator, an action of a reducing agent to an oxidizing compound (a redox initiator) or a physical action such as irradiation of ultraviolet rays or other high energy radiations, high frequencies, etc.

Examples of principal chemical initiators include a persulfate (for example, ammonium persulfate or potassium persulfate, etc.), hydrogen peroxide, a peroxide (for example, benzoyl peroxide or chlorobenzoyl peroxide, etc.) and an azonitrile compound (for example, 4,4'-azobis(4-cyanovaleric acid) and azobisisobutyronitrile, etc.), etc.

Examples of conventional redox initiators include hydrogen-iron (II) salt, potassium persulfate-potassium bisulfate and cerium salt-alcohol, etc.

Examples of the initiators and the functions thereof are described in F. A. Bovey, *Emulsion Polymerization,* issued by Interscience Publishers Inc. New York, 1955, pages 59–93.

As an emulsifier which can be used in the emulsion polymerization, a compound having surface activity is used. Preferred examples thereof include soap, a sulfonate, a sulfate, a cationic compound, an amphoteric compound and a high molecular weight protective colloid. Specific examples of the emulsifiers and the functions thereof are described in *Belgische Chemissche Industrie,* Vol. 28, pages 16–20 (1963).

On the other hand, when dispersing the hydrophobic polymer ultraviolet ray absorbing agent in an aqueous solution of gelatin in the form of latex, an organic solvent used for dissolving the hydrophobic polymer ultraviolet ray absorbing agent is removed from the mixture prior to coating of the dispersion or by volatilization during drying of the dispersion coated, although the latter is less preferable.

Useful solvents include those which have a certain degree of water solubility so as to be capable of being removed by washing with water in a gelatin noodle state and those which can be removed by spray drying, vacuum or steam purging.

Further, examples of the organic solvents capable of being removed include an ester (for example, a lower alkyl ester, etc.), a lower alkyl ether, a ketone, a halogenated hydrocarbon (for example, methylene chloride, trichloroethylene, etc.), a fluorinated hydrocarbon, an alcohol (for example, an alcohol from n-butyl alcohol to octyl alcohol) and a combination thereof.

Any type of dispersing agent can be used in the dispersion of the hydrophobic polymer ultraviolet ray absorbing agent. But ionic surface active agents, and particularly anionic surface active agents are preferred.

Further, it is possible to use ampholytic surface active agents such as C-cetylbetaine, an N-alkylaminopropionate or an N-alkyliminodipropionate, etc.

In order to increase the dispersion stability and to improve the flexibility of the emulsion coated, a small amount (not more than 50% by weight of the ultraviolet ray absorbing polymer) of a permanent solvent, namely, a water-immiscible organic solvent having a high boiling point (i.e., above 200° C.), for example, dibutyl phosphate, tricresyl phosphate, etc., may be added. It is necessary for the concentration of the permanent solvent to be sufficiently low in order to plasticize the polymer while it is kept in a state of a solid particle. Furthermore, when using the permanent solvent, it is preferred that the amount thereof is as small as possible so as to decrease the thickness of the final emulsion layer or the hydrophilic colloid layer in order to maintain good sharpness.

It is preferred that the amount of the ultraviolet ray absorbing agent portion in the ultraviolet ray absorbing polymer latex according to the present invention is generally from 5% to 100% by weight, an amount of from 50% to 100% by weight is more preferred, and an amount of from 70% to 100% by weight is particularly preferred from the viewpoint of the thickness of the layer and stability.

In the following, typical examples of the compounds represented by the general formula (I) and the compounds represented by the general formula (II) of the present invention are set forth, but the present invention is not to be construed as being limited thereto.

Examples of the compounds represented by the general formula (I)

I-1

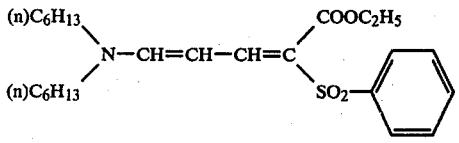

I-2

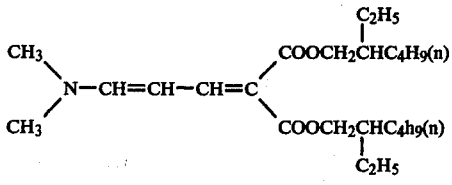

I-3

I-4

-continued
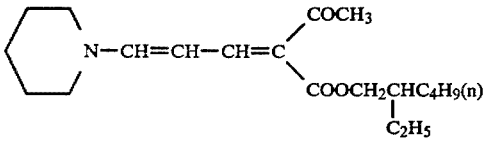
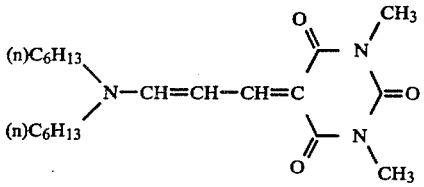
I-5
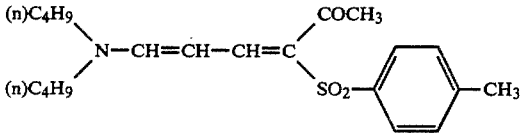
I-6
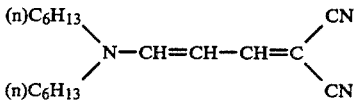
I-7
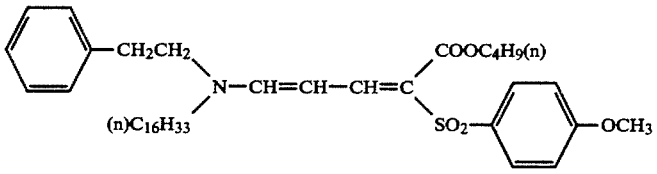
I-8
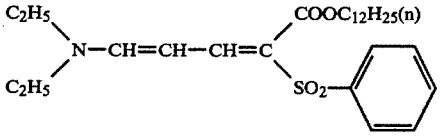
I-9
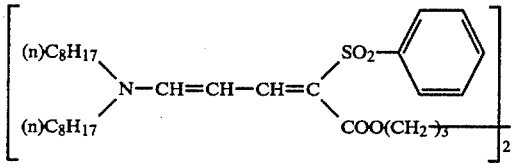
I-10
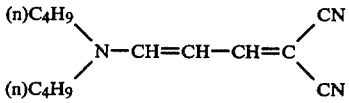
(I-11)
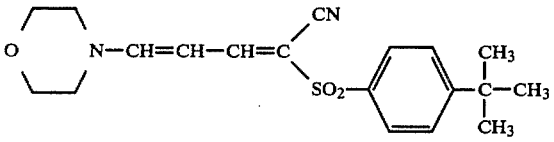
(I-12)
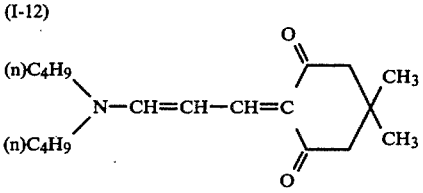
I-13
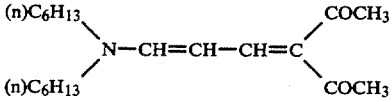
I-14
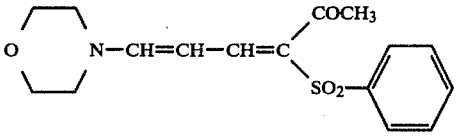
I-15
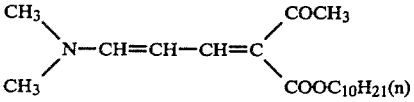
I-16
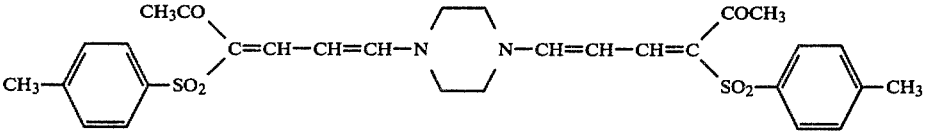
I-17
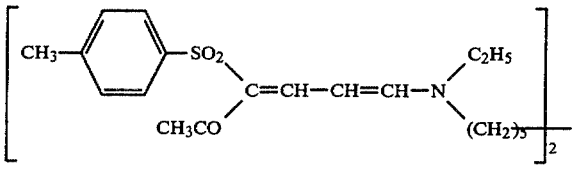
I-18
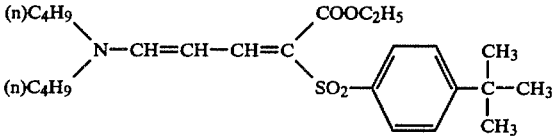

-continued
I-19
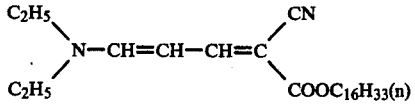
I-20
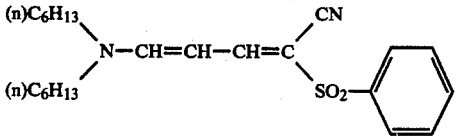
I-21
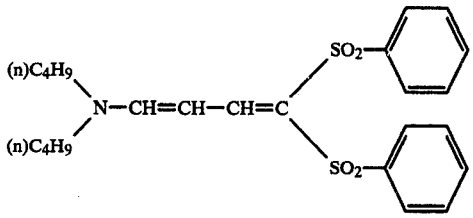
I-22
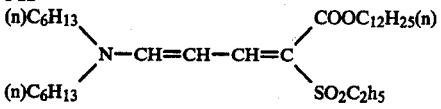
I-23
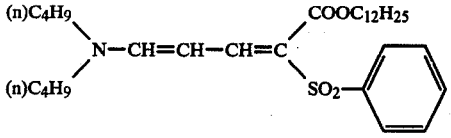
I-24
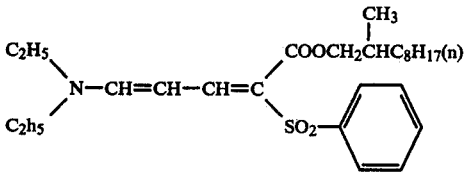
I-25
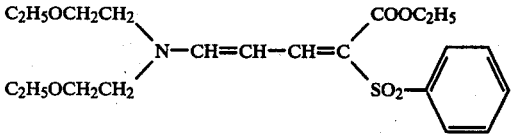
I-26
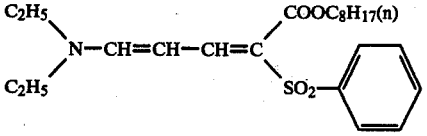
Preferred examples of the compounds represented by the general formula (I) of the present invention include Compounds (I-6), (I-8), (I-10) and (I-26).
Examples of the compounds represented by the general formula (II)
II-1
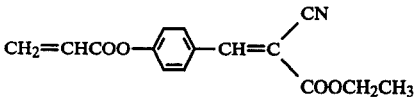
II-2
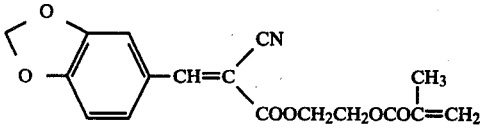
II-3
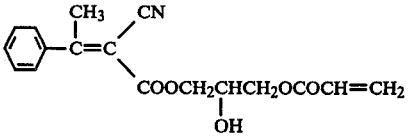
II-4
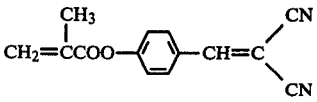
II-5
-continued
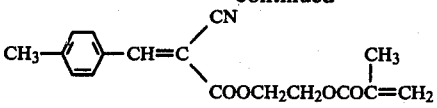
II-6
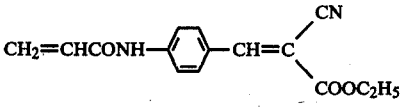
II-7
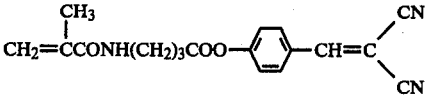
II-8
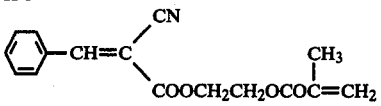
II-9
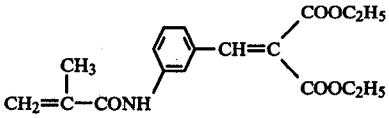
II-10
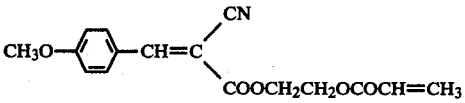
II-11

-continued

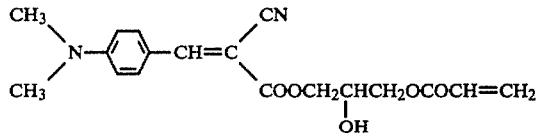

II-12

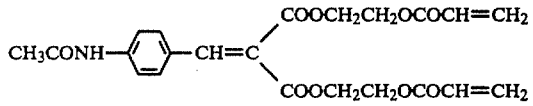

II-13

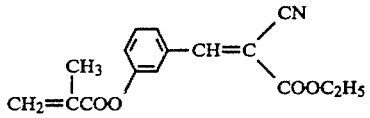

II-14

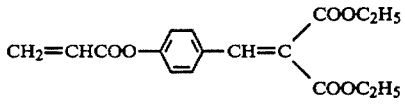

II-15

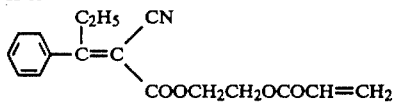

II-16

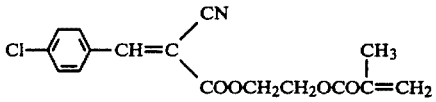

II-17

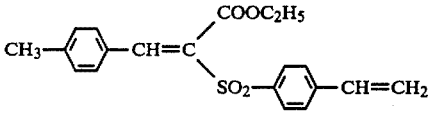

II-18

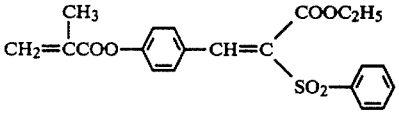

II-19

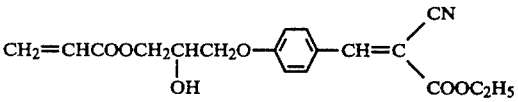

II-20

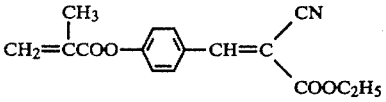

II-21

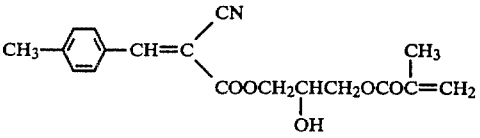

II-22

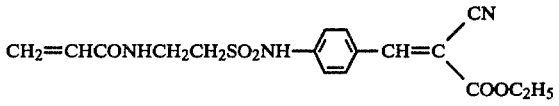

II-23

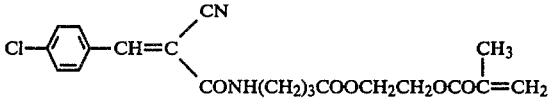

II-24

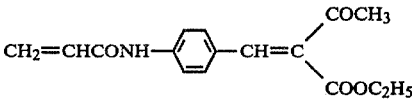

II-25

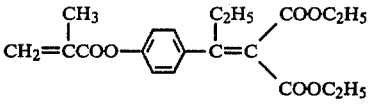

II-26

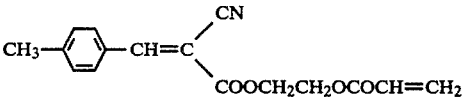

Preferred examples of the compounds represented by the general formula (II) of the present invention include Compounds (II-1), (II-2), (II-5), (II-8) and (II-16).

The compounds represented by the general formula (I) of the present invention can be easily synthesized according to the method as described, for example, in U.S. Pat. No. 4,195,999 (incorporated herein by reference to disclose methods of making compounds of general formula (I)), Japanese Patent Application (OPI) No. 56620/76 (corresponding to U.S. Pat. No. 4,045,229), etc. For reference, specific synthesis examples of the compounds represented by the general formula (I) are set forth below.

SYNTHESIS EXAMPLE I-1

Synthesis of Compound (I-8)

13.3 g of 3-anilinoacroleinanil and 23.1 g of dodecyl phenylsulfonyl acetate were heated at 85° to 90° C. for 2 hours in 40 ml of acetic anhydride. After removing the acetic anhydride under a reduced pressure, 40 ml of ethyl alcohol and 9.5 g of diethylamine were added to the residue and the mixture was refluxed for 2 hours. Then, the ethyl alcohol was distilled off, and the residue was passed through a chromatographic column with Kieselgel 60 (manufactured by Merck Co.) and the benzene effluent was collected, from which 15 g of the desired compound having a melting point of 69° C. was obtained by recrystallization from ethyl alcohol. The identification of the compound was carried out using IR spectrum, NMR spectrum and elemental analysis.

| Elemental Analysis for $C_{27}H_{43}NO_4S$ | H | C | N |
|---|---|---|---|
| Calculated (%): | 9.07 | 67.90 | 2.93 |
| Found (%): | 9.01 | 67.81 | 3.02 |

$\lambda_{max}^{CH_3COOC_2H_5} = 372$ nm

SYNTHESIS EXAMPLE I-2

Synthesis of Compound (I-10)

12.8 g of 3-anilinoacroleinanil and 4.8 g of malononitrile were heated at 85° to 90° C. for 2 hours in 50 ml of acetic anhydride. The acetic anhydride was then removed under a reduced pressure, and to the residue were added 50 ml of ethyl alcohol and 15.0 g of dibutylamine. The mixture was then refluxed for 1 hour. The ethyl alcohol was then distilled off, and the residue was distilled at 157° C. and 0.03 mm Hg to obtain 5.0 g of the desired compound. The identification of the compound was carried out using IR spectrum, NMR spectrum and elemental analysis.

| Elemental Analysis for $C_{14}H_{21}N_3$ | H | C | N |
|---|---|---|---|
| Calculated (%): | 9.15 | 72.69 | 18.16 |
| Found (%): | 9.26 | 72.62 | 18.09 |
| $\lambda_{max}^{CH_3COOC_2H_5} = 378$ nm | | | |

Preferred specific examples of the homopolymer or copolymer ultraviolet ray absorbing agents having a repeating unit derived from a monomer represented by the general formula (II) according to the present invention are set forth below, but the present invention is not to be construed as being limited thereto.

P-1 to P-26: Homopolymers of Compounds (II-1) to (II-26)

P-27: Copolymer of Compound (II-5):methyl methacrylate=7:3 (ratio by weight)

P-28: Copolymer of Compound (II-5):methyl methacrylate=5:5

P-29: Copolymer of Compound (II-5):methyl acrylate=7:3

P-30: Copolymer of Compound (II-8):styrene=5:5

P-31: Copolymer of Compound (II-8):butyl acrylate=7.5:2.5.

P-32: Copolymer of Compound (II-1):methyl methacrylate=7:3

P-33: Copolymer of Compound (II-1):methyl methacrylate=5:5

P-34: Copolymer of Compound (II-8):methyl acrylate=7:3

P-35: Copolymer of Compound (II-2):methyl methacrylate=5:5

P-36: Copolymer of Compound (II-16):methyl methacrylate=7:3

P-37: Copolymer of Compound (II-16):methyl acrylate=5:5

The ultraviolet ray absorbing monomers corresponding to the general formula (II) can be synthesized by reacting a compound synthesized by the process as described, for example, in U.S. Pat. No. 4,200,464, *Beilsteins Handbuch der Organischen Chemie* (4th Edition), Vol. 10, page 521 (1942), etc., with acid halide of acrylic acid or α-substituted acrylic acid such as acryloyl chloride or methacryloyl chloride, and can be synthesized by a reaction of 2-cyano-3-phenylacrylic acid with hydroxyethyl acrylate, hydroxyethyl methacrylate or glycidyl acrylate, etc., as described in Japanese Patent Publication No. 28122/74 or Japanese Patent Application (OPI) No. 11102/73.

The ultraviolet ray absorbing polymer latex composed of a homopolymer or a copolymer having a repeating unit derived from at least one monomer represented by the general formula (II) in which at least one ultraviolet ray absorbing compound represented by the general formula (I) is loaded according to the present invention can be prepared as follows. More specifically, at least one of the above-described ultraviolet absorbing compounds represented by the general formula (I) is loaded into at least one of the above-described ultraviolet absorbing polymer latexes previously prepared in the manner as described in Japanese Patent Application (OPI) No. 56620/76 (corresponding to U.S. Pat. No. 4,045,229), U.S. Pat. No. 4,195,999 (incorporated herein by reference to describe the manner), etc., and the resulting latex can be used. Further, at least one of the above-described ultraviolet ray absorbing homopolymers or copolymers having a repeating unit derived from at least one monomer represented by the general formula (II) and at least one of the above-described ultraviolet ray absorbing compound represented by the general formula (I) are dissolved in an organic solvent having a low boiling point (i.e., up to about 100° C.), for example, ethyl acetate, etc., or in a mixture composed of an organic solvent having a low boiling point and a small amount of an organic solvent having a high boiling point (i.e., at least about 100° C.), for example, dibutyl phosphate, tricresyl phosphate, etc., the solution is emulsified in the manner as described in U.S. Pat. Nos. 3,533,794, 3,253,921 and 3,707,375 (incorporated herein by reference to describe the manner), Japanese Patent Application (OPI) No. 56620/76 (corresponding to U.S. Pat. No. 4,045,229), U.S. Pat. No. 4,195,999, etc., and the resulting latex can be used.

It is preferred that the amount of the ultraviolet ray absorbing compound represented by the general formula (I) is from 50% to 300% by weight based on the amount of the homopolymer or copolymer having a repeating unit derived from a monomer represented by the general formula (II), an amount of from 100% to 200% by weight is more preferred, and an amount of from 100% to 150% by weight is particularly preferred in view of the antistatic property and the color reproducing property.

Specific synthesis examples of the monomer compounds represented by the general formula (II) and the polymer latexes formed therefrom are set forth below.

[A] Syntheses of Monomer Compounds

SYNTHESIS EXAMPLE II-1

Synthesis of Compound (II-5)

400 g of tolualdehyde, 311 g of cyanoacetic acid, 60 ml of acetic acid and 25.6 g of ammonium acetate were refluxed in 1.6 liters of ethyl alcohol for 4 hours with heating. After the reaction, the mixture was concentrated to 600 ml by removing the ethyl alcohol under a reduced pressure, followed by pouring into 1 liter of ice water to separate crystals. The separated crystals were collected by suction filtration and recrystallized from 2 liters of ethyl alcohol to obtain 560 g of 2-cyano-3-(4-methylphenyl)acrylic acid having a melting point of 210° to 215° C. 320 g of the resulting compound and 252 g of thionyl chloride were dissolved in 200 ml of acetonitrile with heating for 1 hour. After the reaction, the acetonitrile and the thionyl chloride were distilled off under a reduced pressure, and the resulting solid was added to a solution containing 244.8 g of hydroxyethyl methacrylate, 149 g of pyridine and 2 liters of acetonitrile. The reaction was carried out for 2 hours while maintaining the reaction temperature below 40° C.

After the reaction, the reacting solution was poured into ice water to separate crystals, and the resulting crystals were recrystallized from 3 liters of ethyl alcohol to obtain 360 g of the desired compound having a melting point of 74° to 75° C. The identification of the compound was carried out using IR spectrum, NMR spectrum and elemental analysis.

| Elemental Analysis for $C_{17}H_{17}NO_4$ | H | C | N |
|---|---|---|---|
| Calculated (%): | 5.72 | 68.22 | 4.68 |
| Found (%): | 5.75 | 68.16 | 4.76 |
| $\lambda_{max}^{CH_3OH}$ = 311 nm | | | |

SYNTHESIS EXAMPLE II-2

Synthesis of Compound (II-8)

200 g of benzaldehyde, 176 g of cyanoacetic acid, 30 ml of acetic acid and 14.5 g of ammonium acetate were refluxed for 4 hours in 800 ml of ethyl alcohol with heating. After the reaction, the mixture was concentrated to 400 ml by removing the ethyl alcohol under a reduced pressure, followed by pouring into 1 liter of ice water to separate crystals. The resulting crystals were recrystallized from 250 ml of acetonitrile to obtain 265 g of 2-cyano-3-phenylacrylic acid having a melting point of 184° to 188° C. 150 g of the resulting compound and 176 g of thionyl chloride were dissolved in 100 ml of acetonitrile with heating for 1 hour. After the reaction, the acetonitrile and the thionyl chloride were distilled off under a reduced pressure, and the resulting solid was added to a solution containing 124 g of hydroxyethyl methacrylate, 75 g of pyridine and 1 liter of acetonitrile. The reaction was carried out for 2 hours while maintaining the reaction temperature below 40° C. After the reaction, the reacting solution was poured into ice water to separate crystals, and the resulting crystals were recrystallized from 1 liter of ethyl alcohol to obtain 205 g of the desired compound having a melting point of 68° to 70° C. The identification of the compound was carried out using IR spectrum, NMR spectrum and elemental analysis.

| Elemental Analysis for $C_{16}H_{14}NO_4$ | H | C | N |
|---|---|---|---|
| Calculated (%): | 4.96 | 67.60 | 4.93 |
| Found (%): | 4.87 | 67.65 | 4.99 |
| $\lambda_{max}^{CH_3OH}$ = 298 nm | | | |

SYNTHESIS EXAMPLE II-3

Synthesis of Compound (II-1)

30 g of 4-hydroxybenzaldehyde, 31.7 g of ethyl cyanoacetate, 4.5 ml of acetic acid and 1.9 g of ammonium acetate were refluxed in 100 ml of ethyl alcohol for 4 hours with heating. After the reaction, the reaction solution was poured into 500 ml of ice water to separate crystals. The resulting crystals were recrystallized from 400 ml of methyl alcohol to obtain 65 g of ethyl 2-cyano-3-(4-hydroxyphenyl)acrylate having a melting point of 89° to 91° C. 10.9 g of the resulting compound and 4.3 g of pyridine were dissolved in 100 ml of tetrahydrofuran, and 4.5 g of acryloyl chloride was added dropwise thereto. The reaction was carried out for 2 hours while maintaining the reaction temperature below 40° C. After the reaction, the reacting solution was poured into ice water to separate crystals, and the resulting crystals were recrystallized from 100 ml of methyl alcohol to obtain 11 g of the desired compound having a melting point of 82° to 85° C. The identification of the compound was carried out using IR spectrum, NMR spectrum and elemental analysis.

| Elemental Analysis for $C_{15}H_{13}NO_4$ | H | C | N |
|---|---|---|---|
| Calculated (%): | 4.83 | 66.41 | 5.16 |
| Found (%): | 4.91 | 66.42 | 5.08 |
| $\lambda_{max}^{CH_3OH}$ = 323 nm | | | |

SYNTHESIS EXAMPLE II-4

Synthesis of Compound (II-21)

9.4 g of 2-cyano-3-(4-methylphenyl)acrylic acid obtained by the process described in Synthesis Example II-1, 7.1 g of glycidyl methacrylate and 2.5 g of triethylamine were refluxed for 5 hours in 120 ml of methyl ethyl ketone with heating. After the reaction, the methyl ethyl ketone was distilled off under a reduced pressure, and the residue was subjected to column chromatography (Kieselgel 60, manufactured by Merck Co.) to collect ethyl acetate/hexane effluent. When recrystallization was carried out from methyl alcohol, 7 g of the desired compound having a melting point of 52° to 53° C. was obtained. The identification of the compound was carried out using IR spectrum, NMR spectrum and elemental analysis.

| Elemental Analysis for $C_{18}H_{19}NO_5$ | H | C | N |
|---|---|---|---|
| Calculated (%): | 5.81 | 65.64 | 4.25 |
| Found (%): | 5.90 | 65.52 | 4.30 |
| $\lambda_{max}^{CH_3OH}$ = 311 nm | | | |

[B] Syntheses of Polymer Latexes

SYNTHESIS EXAMPLE III-1

Loading of Compound (I-8) into Homopolymer Latex of Compound (II-5)

800 ml of an aqueous solution containing 10 g of sodium salt of oleylmethyltauride dissolved was heated to 90° C. while gradually introducing nitrogen gas therethrough under stirring. To the resulting mixture, 20 ml of an aqueous solution containing 350 mg of potassium persulfate was added. Then, a solution prepared by dissolving 50 g of Ultraviolet Ray Absorbing Monomer (II-5) and 35 g of Ultraviolet Ray Absorbing Compound (I-8) in 300 ml of ethyl alcohol by heating was added thereto. After the completion of the addition, the mixture was stirred for 1 hour while heating at 85° to 90° C., and 10 ml of an aqueous solution containing 150 mg of potassium persulfate was added thereto. After the reaction was further carried out for 1 hour, the ethyl alcohol was distilled off as an azeotropic mixture with water. The latex thus formed was cooled. After the pH was adjusted to 6.0 with a 1N sodium hydroxide solution, the latex was filtered. The concentration of the solid component in the latex was 10.35%. Further, the latex had absorption maxima at 325 nm and 375 nm in the aqueous system.

SYNTHESIS EXAMPLE III-2

Loading of Compound (I-10) into Copolymer Latex of Compound (II-8) and n-Butyl Acrylate 1 liter of an aqueous solution containing 15 g of sodium salt of oleylmethyltauride dissolved was heated to 90° C. while gradually introducing nitrogen gas therethrough under stirring. To the resulting mixture, 20 ml of an aqueous solution containing 525 mg of potassium persulfate was added. Then, 50 g of Ultraviolet Ray Absorbing Monomer (II-8), 25 g of n-butyl acrylate and 25 g of Ultraviolet Ray Absorbing Compound (I-10) were dissolved in 200 ml of ethanol with heating, and the resulting solution was added to the mixture. After the completion of the addition, the mixture was stirred for 1 hour with heating at 85° to 90° C., and 10 ml of an aqueous solution containing 225 mg of potassium persulfate was added thereto. After the reaction was further carried out for 1 hour, the ethanol and the n-butyl acrylate not reacted were distilled off as an azeotropic mixture with water. The latex thus formed was cooled. After the pH was adjusted to 6.0 with a 1N sodium hydroxide solution, the latex was filtered. The concentration of the solid component in the latex was 8.96%. Further, the latex had absorption maxima at 315 nm and 381 nm in the aqueous system.

SYNTHESIS EXAMPLE III-3

Loading of Compound (I-8) into Copolymer Latex of Compound (II-5) and Methyl Methacrylate 7.5 liters of an aqueous solution containing 75 g of sodium salt of oleylmethyltauride dissolved was heated to 90° C. while gradually introducing nitrogen gas therethrough under stirring. To the resulting mixture, 50 ml of an aqueous solution containing 2.6 g of potassium persulfate was added. Then, 300 g of Ultraviolet Ray Absorbing Monomer (II-5), 60 g of methyl methacrylate and 300 g of Ultraviolet Ray Absorbing Compound (I-8) were dissolved in 1 liter of ethanol, and the resulting solution was added to the mixture. After the completion of the addition, the mixture was stirred for 1 hour while heating at 85° to 90° C., and 20 ml of an aqueous solution containing 1.1 g of potassium persulfate was added thereto. After the reaction was further carried out for 1 hour, the ethanol and the methyl methacrylate not reacted were distilled off as an azeotropic mixture with water. The latex thus formed was cooled. After the pH was adjusted to 6.0 with a 1N sodium hydroxide solution, the latex was filtered. The concentration of the solid component in the latex was 9.12%. Further, the latex had absorption maxima at 328 nm and 375 nm in the aqueous system.

SYNTHESIS EXAMPLE III-4

Synthesis of Hydrophobic Polymer Ultraviolet Ray Absorbing Agent (1)

21 g of Ultraviolet Ray Absorbing Monomer (II-8) and 9 g of methyl acrylate were dissolved in 150 ml of dioxane. While stirring the resulting solution with heating at 70° C. under nitrogen atmosphere, a solution prepared by dissolving 270 mg of 2,2'-azobis-(2,4-dimethylvaleronitrile) in 5 ml of dioxane was added, and the reaction was carried out for 5 hours. Then, the resulting product was poured into 2 liters of ice water, and the solid thus deposited was collected by filtration and thoroughly washed with water. The product was dried to obtain 25.3 g of the hydrophobic polymer ultraviolet ray absorbing agent. As the result of nitrogen analysis of the hydrophobic polymer ultraviolet ray absorbing agent, it was found that the copolymer synthesized contained 64.5% of the ultraviolet ray absorbing monomer unit.

$\lambda_{max}^{CH_3COOC_2H_5} = 300$ nm

Synthesis of Coemulsification Latex (A) of Compound (I-10) and Hydrophobic Polymer Ultraviolet Ray Absorbing Agent (1)

Two solutions (a) and (b) were prepared in the following manner.

Solution (a): 70 g of a 10% by weight aqueous solution of bone gelatin (pH: 5.6 at 35° C.) was heated to 32° C. to dissolve.

Solution (b): 2.5 g of the above described hydrophobic polymer and 3 g of Ultraviolet Ray Absorbing Compound (I-10) were dissolved in 20 g of ethyl acetate at 38° C., and 10 ml of a 70% by weight methanol solution of sodium dodecylbenzenesulfonate was added thereto.

Then, solutions (a) and (b) were put into a mixer with explosion preventing equipment. After stirring for 1 minute at a high speed, the operation of the mixer was stopped and the ethyl acetate was distilled off under a reduced pressure. Thus, Latex (A) wherein the hydrophobic polymer ultraviolet ray absorbing agent was dispersed in a diluted aqueous solution of gelatin was obtained.

SYNTHESIS EXAMPLE III-5

Synthesis of Hydrophobic Polymer Ultraviolet Ray Absorbing Agent (2)

63 g of the Ultraviolet Ray Absorbing Monomer (II-5) and 27 g of methyl methacrylate were dissolved in 450 ml of dioxane. While stirring the resulting solution with heating at 70° C. under nitrogen atmosphere, a solution prepared by dissolving 810 mg of 2,2'-azobis-(2,4-dimethylvaleronitrile) in 15 ml of dioxane was added, and the reaction was carried out for 5 hours. Then, the resulting product was poured into 5 liters of ice water, and the solid thus deposited was collected by filtration and thoroughly washed with water and then methanol. The product was dried to obtain 78 g of a hydrophobic polymer ultraviolet ray absorbing agent. As the result of nitrogen analysis of the hydrophobic polymer ultraviolet ray absorbing agent, it was found that the copolymer synthesized contained 66.3% of the ultraviolet ray absorbing monomer unit.

$\lambda_{max}^{CH_3COOC_2H_5} = 315$ nm

Synthesis of Coemulsification Latex (B) of Compound (I-8) and Hydrophobic Polymer Ultraviolet Ray Absorbing Agent (2)

Latex (B) was prepared by the same procedure as that for the above-described Latex (A) using 2.5 g of Ultraviolet Ray Absorbing Compound (I-8) and 2.5 g of Hydrophobic Polymer Ultraviolet Ray Absorbing Agent (2).

The ultraviolet ray absorbing polymer latex of the present invention is used by adding it to the hydrophilic colloid layers of silver halide photographic light-sensitive materials, such as a surface protective layer, an intermediate layer or a silver halide emulsion layer, etc. It is preferred to use it in the surface protective layer or a hydrophilic colloid layer adjacent to the surface protective layer. Particularly, it is preferable to add it to the lower layer in the surface protective layer consisting of two layers.

An amount of the ultraviolet ray absorbing polymer latex used in the present invention is not restricted, but it is preferred to be in a range of from 10 mg to 2,000 mg, more preferably from 50 mg to 1,000 mg, and particularly preferably from 100 mg to 500 mg per square meter.

Examples of silver halide photographic light-sensitive materials to which the present invention can be applied include color negative films, color reversal films, color papers and light-sensitive materials for color diffusion transfer processes, etc. Particularly preferred examples of silver halide photographic light-sensitive material to which the present invention can be applied include color negative films, color reversal films, and light-sensitive material for color diffusion transfer processes.

By loading the ultraviolet ray absorbing compound represented by the general formula (I) into the ultraviolet ray absorbing polymer latex having a repeating unit derived from a monomer represented by the general formula (II) in accordance with the present invention, it is possible to prevent the influence of ultraviolet rays over a wide range and the remarkable effects as described above can be achieved without using an organic solvent having a high boiling point.

In the following, components other than the ultraviolet ray absorbing polymer latex used in the silver halide photographic light-sensitive materials of the present invention and methods for development, processing, etc., are described briefly.

As protective colloids for the hydrophilic colloid layers of the present invention, gelatin is advantageously used, but other hydrophilic colloids may be used.

For example, it is possible to use proteins such as gelatin derivatives, graft polymers of gelatin with other high polymers, albumin or casein, etc.; saccharose derivatives such as cellulose derivatives such as hydroxyethyl cellulose, carboxymethyl cellulose or cellulose sulfate, etc., sodium alginate or starch derivatives, etc.; and various synthetic hydrophilic high molecular substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole, etc.

Useful gelatins include lime-processed gelatin as well as acid-processed gelatin and enzyme-processed gelatin as described in *Bull. Soc. Sci. Phot. Japan,* No. 16, page 30 (1966). Further, hydrolyzed products and enzymatic decomposition products of gelatin can be used.

Examples of useful silver halides for the silver halide emulsion layers of the present invention include silver bromide, silver iodobromide, silver iodochlorobromide, silver chlorobromide and silver chloride.

The silver halide emulsions used in the present invention can be prepared by processes described in P. Glafkides, *Chimie et Physique Photographique* (issued by Paul Montel Co., 1967), G. F. Duffin, *Photographic Emulsion Chemistry* (issued by The Focal Press, 1966) and V. L. Zelikman et al., *Making and Coating Photographic Emulsion* (issued by The Focal Press, 1966), etc. Namely, any of an acid process, a neutral process and an ammonia process may be used. Further, as a type of reacting soluble silver salts with soluble halogen salts, it is possible to use any of the one-side mixing processes, a simultaneous mixing process and combinations thereof.

A process for forming silver halide particles in an excess amount of silver ions (the so-called reversal mixing process) can also be used. A useful type of simultaneous mixing process is a process wherein a liquid phase for forming silver halide is kept at a constant pAg, namely, the so-called controlled double jet process.

According to this process, silver halide emulsions having a regular crystal form and a nearly uniform particle size are obtained.

Cadmium salts, zinc salts, lead salts, thallium salts, iridium salts or complex salts thereof, rhodium salts or complex salts thereof, and iron salts or complex salts thereof may be coexistent in the step of forming silver halide particles or the step of physical ageing.

The silver halide emulsions of the present invention can be chemically sensitized by conventional methods.

Namely, it is possible to use a sulfur sensitization process using active gelatin or sulfur containing compounds capable of reacting with silver (for example, thiosulfates, thioureas, mercapto compounds and rhodanines), a reduction sensitization process using reducing subtances (for example, stannous salts, amines, hydrazine derivatives, formamidine sulfinic acid and silane compounds) and a noble metal sensitization process using noble metal compounds (for example, gold complex salts and complex salts of metals belonging to Group VIII in the Periodic Table, such as Pt, Ir or Pd, etc.), which may be used alone or as a combination.

In order to prevent fogging when producing the light-sensitive materials, during preservation or during photographic treatment or to stabilize photographic properties, various compounds can be incorporated in the silver halide emulsions of the present invention. Namely, it is possible to add various compounds known as anti-fogging agents or stabilizers, such as azoles, for example, benzothiazolium salts, nitroindazoles, triazoles, benzotriazoles and benzimidazoles (particularly, nitro- or halogen-substituted derivatives); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above-described heterocyclic mercapto compounds which have water-soluble groups such as a carboxyl group or a sulfo group, etc.; thioketo compounds, for example, oxazolinethione; azaindenes, for example, tetraazaindenes (particularly, 4-hydroxy-substituted-(1,3,3a,7)tetraazaindenes); benzenethiosulfonic acids; and benzenesulfinic acid; etc.

The hydrophilic colloid layers in the light-sensitive materials of the present invention may contain various surface active agents for various purposes such as coating assistants, prevention of electrically charging, improvement of slipping property, emulsifying and dispersing, prevention of adhesion and improvement of photographic properties (for example, acceleration of development, hard tone, and sensitization), etc.

For example, it is possible to use nonionic surface active agents such as saponin (steroid type), alkylene oxides (for example, polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines or amides, and polyethylene oxide addition products of silicone), glycidol derivatives (for example, alkenylsuccinic acid polyglycerides and alkylphenol polyglycerides), aliphatic acid esters of polyhydric alcohols, or alkyl esters of saccharose, etc.; anionic surface active agents having acid groups such as a carboxyl group, a sulfo group, a phospho group, a sulfuric acid ester group or a phosphoric acid ester group, etc., such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylene alkyl phenyl esters or polyoxyethylene alkylphosphoric acid esters, etc.; ampholytic surface active agents such as amino acids, aminoalkylsulfonic acids, aminoalkylsulfuric or phosphoric acid esters, alkylbetaines or amineoxides, etc.; and cationic surface active agents such as alkylamine salts, aliphatic or aromatic quaternary ammonium salts, heterocyclic quaternary ammonium salts such as pyridinium salts or imidazolium salts, etc., or aliphatic or heterocyclic phosphonium or sulfonium salts, etc.

The silver halide emulsions of the present invention may be spectrally sensitized by methine dyes or others. These sensitizing dyes can be used alone, but combinations of them may be used. Combinations of sensitizing dyes are frequently used for the purpose of supersensitization. The emulsion may contain dyes which do not have a spectral sensitization function themselves or substances which do not substantially absorb visible light but have a function of supersensitization, together with the sensitizing dyes.

Useful sensitizing dyes, combinations of dyes having a function of supersensitization and substances having a function of supersensitization have been described in *Research Disclosure,* Vol. 176, 17643 (Dec., 1978), page 23, paragraph IV-J.

The hydrophilic colloid layers such as a silver halide emulsion layer or a surface protective layer in the present invention may contain inorganic or organic hardening agents. For example, it is possible to use chromium salts (chromium alum or chromium acetate, etc.), aldehydes (formaldehyde, glyoxal or glutaraldehyde, etc.), N-methylol compounds (dimethylolurea, or methyloldimethyl hydantoin, etc.), dioxane derivatives (2,3-dihydroxydioxane, etc.), active vinyl compounds (1,3,5-triacryloyl-hexahydro-s-triazine or 1,3-vinylsulfonyl-2-propanol, etc.), active halogen compounds (2,4-dichloro-6-hydroxy-s-triazine, etc.) and mucohalogenic acids (mucochloric acid or nucophenoxychloric acid, etc.), which may be used alone or as a combination.

The photographic light-sensitive materials of the present invention may contain color forming couplers, namely, compounds capable of coloring by oxidative coupling with an aromatic primary amine developing agent (for example, phenylenediamine derivatives or aminophenol derivatives, etc.) by color development. Examples of them include 5-pyrazolone couplers, pyrazolobenzimidazole couplers, cyanoacetylcoumarone couplers and ring-opened acylacetonitrile couplers, etc., as magenta couplers; acylacetamide couplers (for example, benzoylacetanilides and pivaloylacetanilides), etc., as yellow couplers; and naphthol couplers and phenol couplers, etc., as cyan couplers. These couplers are preferred to have hydrophobic groups called ballast groups in the molecule so as to be non-diffusible. The couplers may be any of 4-equivalence and 2-equivalence to silver ion. Further, they may be colored couplers having an effect of color correction or couplers which release a development inhibitor by development (the so-called DIR couplers).

Further, noncoloring DIR coupling compounds which produce a colorless product by coupling reaction and release a developing inhibitor may be contained in addition to DIR couplers.

The light-sensitive materials of the present invention may contain hydroquinone derivatives, aminophenol derivatives, gallic acid derivatives and ascorbic acid derivatives, etc., as anti-color-fogging agents.

When practicing the present invention, the following known antifading agents can be used together. Further, color image stabilizers used in the present invention may be used alone or in a combination of two or more thereof. Examples of known antifading agents include hydroquinone derivatives, gallic acid derivatives, p-alkoxyphenols, p-oxyphenol derivatives and bisphenols.

The hydrophilic colloid layers of the photographic light-sensitive materials of the present invention can contain a water-insoluble or nearly insoluble synthetic polymer dispersion for the purpose of improvement of dimensional stability. For example, it is possible to use polymers composed of one or more of alkyl acrylate (or methacrylate), alkoxyalkyl acrylate (or methacrylate), glycidyl acrylate (or methacrylate), acrylamide (or methacrylamide), vinyl ester (for example, vinyl acetate), acrylonitrile, olefin and styrene, etc., and polymers composed of a combination of the above-described monomer components and acrylic acid, methacrylic acid, $\alpha,\beta$-unsaturated dicarboxylic acid, hydroxyalkyl acrylate (or methacrylate), sulfoalkyl acrylate (or methacrylate) or styrenesulfonic acid, etc.

The present invention is suitably applied to multilayer color photographic materials comprising at least two layers having each a different spectral sensitivity on a base. The multilayer color photographic materials generally have at least each a red-sensitive emulsion layer, a green-sensitive emulsion layer and a blue-sensitive emulsion layer on the base. The order of these layers can be suitably selected as occasion demands. Generally, the red-sensitive emulsion layer contains cyan forming couplers, the green-sensitive emulsion layer contains magenta forming couplers and the blue-sensitive emulsion layer contains yellow forming couplers, but other combinations may be adopted, if necessary.

Exposure to light for obtaining photographic images may be carried out by the conventional method. Namely, it is possible to use various known light sources such as natural light (sunlight), a tungsten light, a fluorescent light, a mercury lamp, a xenon arc lamp, a carbon arc lamp, a xenon flash light, or a cathode ray tube flying spot, etc. As exposure time, not only exposure for 1/1,000 second to 1 second which is used for conventional cameras, but also exposure shorter than 1/1,000 second, for example, $1/10^4$ to $1/10^6$ second in case of the xenon flash light or the cathode ray tube, and exposure longer than 1 second can be used. If necessary, the spectral composition of light used for exposure can be controlled by a color filter.

Photographic processings of the light-sensitive materials of the present invention can be carried out by any known methods. Known processing solutions can be used. The processing temperature is generally selected from a range of 18° C. to 50° C., but a temperature lower than 18° C. or a temperature higher than 50° C. may be used, too. Any of a development processing for forming silver images (black-and-white photographic processing) and a color photographic processing comprising a development processing for forming dye images can be adopted as occasion demands.

The developing solution used in case of black-and-white photographic processing may contain known developing agents. Examples of developing agents include dihydroxybenzenes (for example, hydroquinone), 3-pyrazolidones (for example, 1-pehnyl-3-pyrazolidone), aminophenols (for example, N-methyl-p-aminophenol), 1-phenyl-3-pyrazolines, ascorbic acid, and heterocyclic compounds such as those wherein a 1,2,3,4-tetrahydroquinone ring and an indoline ring are condensed as described in U.S. Pat. No. 4,067,872, which can be used alone or as a combination of them. The developing solution generally contains known preservatives, alkali agents, pH buffer agents and antifogging agents, etc. If necessary, it may contain dissolving assistants, toning agents, development accelerators, surface active agents, defoaming agents, water softeners, hardening agents and viscosity increasing agents, etc.

In one special type of development processing, the developing agent may be contained in the light-sensitive material, for example, in an emulsion layer, and the light-sensitive material is developed by processing in an aqueous alkali solution. Among the developing agents, hydrophobic agents can be incorporated in the emulsion layer as a latex dispersion as disclosed in *Research Disclosure,* No. 169 as RD-16928. Such a development processing may be combined with a silver salt stabilization processing using thiocyanates.

Conventional fixing solutions can be used.

Examples of useful fixing agents include thiosulfates, thiocyanates, and known organic sulfur compounds having an effect as a fixing agent.

The fixing solution may contain water-soluble aluminum salts as a hardening agent.

When forming color images, known processes can be utilized.

It is possible to use a negative-positive process (for example, described in *Journal of the Society of Motion Picture and Television Engineers,* Vol. 61 (1953), pages 667–701) and a color reversal process for forming color positive images which comprises forming negative silver images by developing with a developer containing a black-and-white developing agent, subjecting to at least one uniform exposure to light or another suitable fogging treatment, and subsequently carrying out color development, etc.

The color developing solution generally comprises an aqueous alkaline solution containing a color developing agent. As the color developing agent, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, it is possible to use substances described in L. F. A. Mason, *Photographic Processing Chemistry* (issued by Focal Press, 1966), pages 226–229, U.S. Pat. Nos. 2,193,015 and 2,592,364 and Japanese Patent Application (OPI) No. 64933/73, etc.

The color developing solution may contain pH buffer agents such as sulfites, carbonates, borates and phosphates of alkali metals, and development restrainers or antifogging agents such as bromides, iodides or organic antifoggants, etc. Further, it may contain, if desired, water softeners, preservatives such as hydroxylamine, organic solvents such as benzyl alcohol or diethylene glycol, development accelerators such as polyethylene glycol, quaternary ammonium salts or amines, dye forming couplers, competing couplers, fogging agents such as sodium borohydride, auxiliary developing agents such as 1-phenyl-3-pyrazolidone, viscosity imparting agents, polycarboxylic acid type chelating agents described in U.S. Pat. No. 4,083,723 and antioxidants described in German Patent Application (OLS) No. 2,622,950, etc.

The photographic emulsion layers after color development are generally subjected to bleaching processing. The bleaching processing may be carried out simultaneously with fixation processing or may be carried out respectively. As bleaching agents, compounds of polyvalence metals such as iron (III), cobalt (III), chromium (VI) or copper (II), peracids, quinones and nitroso compounds, etc., are used. For example, it is possible to use ferricyanides, bichromates, organic complex salts of iron (III) or cobalt (III), for example, complex salts of aminopolycarboxylic acids such as ethylenediaminetetraacetic acid, nitrilotriacetic acid or 1,3-diamino-2-propanol tetraacetic acid, etc., and organic acids such as citric acid, tartaric acid or malic acid, etc.; persulfates, permanganates; and nitrosophenols, etc. Among them, potassium ferricyanide, sodium ethylenediaminetetraacetato iron (III) complex and ammonium ethylenediaminetetraacetato iron (III) complex are particularly useful. Ethylenediaminetetraacetato iron (III) complexes are useful for both of the bleaching solution and the mono bath bleach-fixing solution.

In the following, the present invention is illustrated in greater detail with reference to examples. However, the invention is not limited in scope to these examples.

EXAMPLE 1

In order to compare Coemulsification Latexes (A) and (B) prepared in Synthesis Examples III-4 and III-5 with a combination of Compound (I-10) and Monomer (II-8), a combination of Compound (I-8) and Monomer (II-5) and a combination of Compound (I-8) and Ultraviolet Ray Absorbing Agent (1) having the structure described below, Emulsified Dispersions (C), (D) and (E) were prepared by emulsifying Compound (I-10) and Monomer (II-8), Compound (I-8) and Monomer (II-5) and Compound (I-8) and Ultraviolet Ray Absorbing Agent (1), respectively, using an organic solvent having a high boiling point in the manner as described below.

Ultraviolet Ray Absorbing Agent (1)

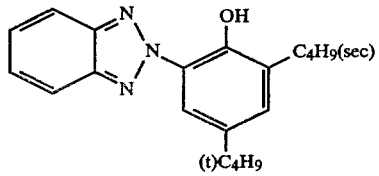

Two kinds of solutions (i) and (ii) were prepared in the following manner.

Solution (i): 1,000 g of a 10% by weight aqueous solution of bone gelatin (pH: 5.6 at 35° C.) was heated to 40° C. to dissolve.

Solution (ii): 58 g of Compound (I-10) and 30 g of Monomer (II-8) were dissolved in a solvent mixture composed of 90 g of dibutyl phthalate and 180 g of ethyl acetate as an auxiliary solvent at 38° C., and 57 g of a 72% by weight methanol solution of sodium dodecylbenzenesulfonate was added to the resulting solution.

Then, solutions (i) and (ii) were put into a mixer with explosion preventing equipment. After being stirred for 1 minute at a high speed, the operation of the mixer was stopped and the ethyl acetate was distilled off under a reduced pressure. Thus, Emulsified Dispersion (C) containing Compound (I-10) and Monomer (II-8) was prepared.

Emulsified Dispersion (D) and Emulsified Dispersion (E) were prepared using 62 g of Compound (I-8) and 35 g of Monomer (II-5) and 62 g of Compound (I-8) and 43 g of Ultraviolet Ray Absorbing Agent (1), respectively, in the same procedure as in Emulsified Dispersion (C).

When carrying out emulsification of the components to prepare Emulsified Dispersions (C), (D) and (E), if dibutyl phthalate was not used, coarse crystals were separated within a very short time after emulsification, whereby not only the ultraviolet ray absorbing property varied but also the coating property remarkably deteriorated.

Figure 1:
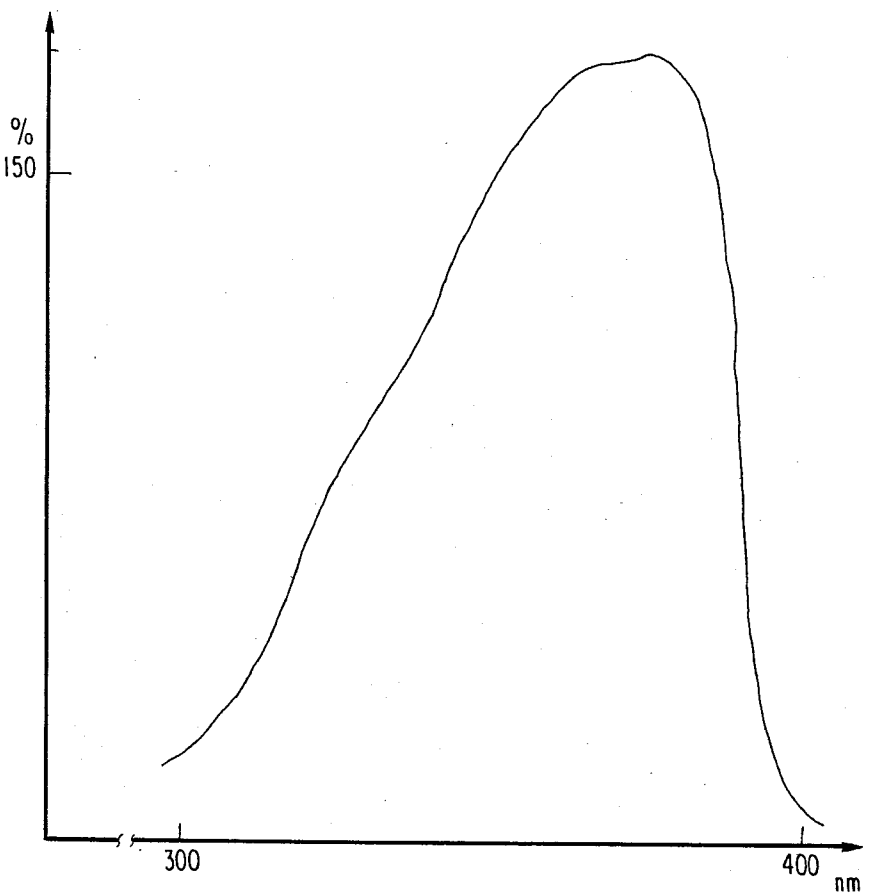
Figure 2C:
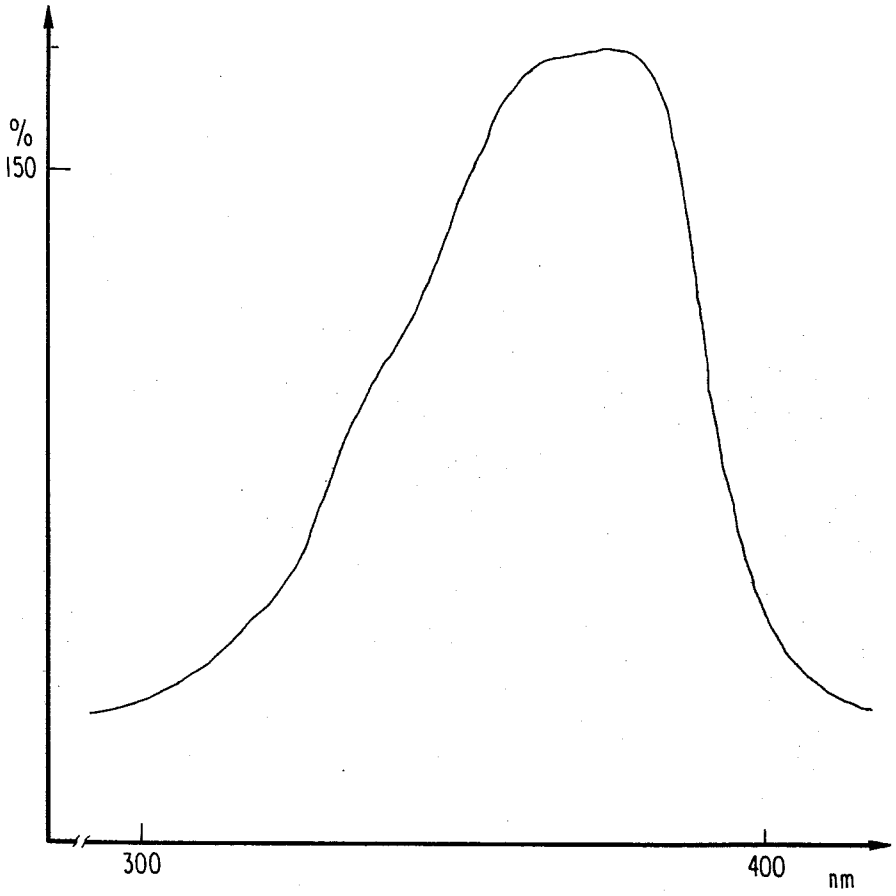
Figure 2B:
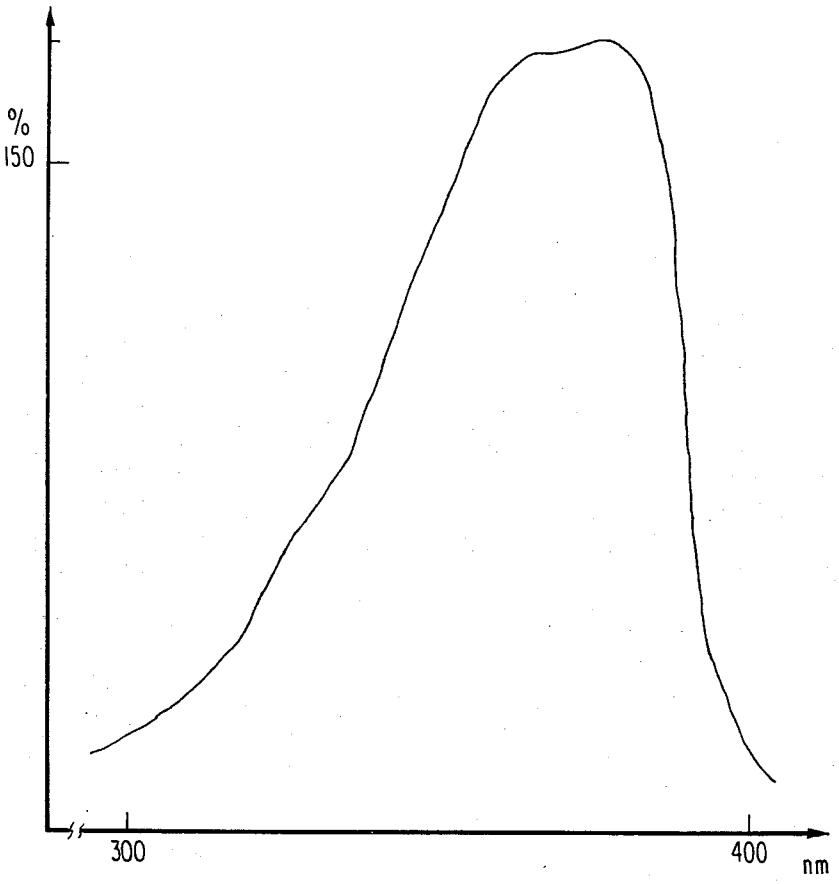

Spectral absorption characteristics of samples which were prepared by applying the above-described emulsified dispersions to a cellulose triacetate support in an amount of 4.0 g/m$^2$, respectively, were measured by means of a Hitachi 323 type self-recording spectrodensitometer, and the results shown in FIGS. 1 (a, b, c, d and e) were obtained.

It is apparent from FIGS. 1 (a, b, c, d and e) that the absorption peaks of (A) and (B) are maintained surprisingly sharp as compared with (C), (D) and (E), in spite of polymer latexes.

The results shown in FIG. 1 are surprising matters, because it has been believed generally that the spectral absorption peak of a polymer obtained by polymerization of the monomer is broader than that of the monomer and such polymer cannot be practically used as a photographic ultraviolet ray absorbing agent.

EXAMPLE 2

A multilayer color photographic light-sensitive material comprising layers having the compositions described below on a cellulose triacetate film support was prepared.

The 1st Layer: Antihalation layer (AHL)

A gelatin layer containing black colloidal silver.

The 2nd Layer: Intermediate layer (ML)

A gelatin layer containing an emulsified dispersion of 2,5-di-tert-octylhydroquinone.

The 3rd Layer: The first red-sensitive emulsion layer ($RL_1$)

Silver iodobromide emulsion (silver iodide: 5% by mol), Amount of silver coated: 1.79 g/m$^2$

| | |
|---|---|
| Sensitizing Dye I | $6 \times 10^{-5}$ mol per mol of silver |
| Sensitizing Dye II | $1.5 \times 10^{-5}$ mol per mol of silver |
| Coupler A | 0.04 mol per mol of silver |
| Coupler C-1 | 0.0015 mol per mol of silver |
| Coupler C-2 | 0.0015 mol per mol of silver |
| Coupler D | 0.0006 mol per mol of silver |

The 4th Layer: The second red-sensitive emulsion layer ($RL_2$)

Silver iodobromide emulsion (silver iodide: 4% by mol), Amount of silver coated: 1.4 g/m$^2$

| | |
|---|---|
| Sensitizing Dye I | $3 \times 10^{-5}$ mol per mol of silver |
| Sensitizing Dye II | $1.2 \times 10^{-5}$ mol per mol of silver |
| Coupler A | 0.02 mol per mol of silver |
| Coupler C-1 | 0.0008 mol per mol of silver |
| Coupler C-2 | 0.0008 mol per mol of silver |

The 5th Layer: Intermediate layer (ML)

The same as the 2nd layer.

The 6th Layer: The first green-sensitive emulsion layer ($GL_1$)

Silver iodobromide emulsion (silver iodide: 4% by mol), Amount of silver coated: 1.5 g/m$^2$

| | |
|---|---|
| Sensitizing Dye III | $3 \times 10^{-5}$ mol per mol of silver |
| Sensitizing Dye IV | $1 \times 10^{-5}$ mol per mol of silver |
| Coupler B | 0.05 mol per mol of silver |
| Coupler M-1 | 0.008 mol per mol of silver |
| Coupler D | 0.0015 mol per mol of silver |

The 7th Layer: The second green-sensitive emulsion layer ($GL_2$)

Silver iodobromide emulsion (silver iodide: 5% by mol), Amount of silver coated: 1.6 g/m$^2$

| | |
|---|---|
| Sensitizing Dye III | $2.5 \times 10^{-5}$ mol per mol of silver |
| Sensitizing Dye IV | $0.8 \times 10^{-5}$ mol per mol of silver |
| Coupler B | 0.02 mol per mol of silver |
| Coupler M-1 | 0.003 mol per mol of silver |
| Coupler D | 0.0003 mol per mol of silver |

The 8th Layer: Yellow filter layer (YFL)

A gelatin layer containing yellow colloidal silver and an emulsified dispersion of 2,5-di-tert-octylhydroquinone in an aqueous solution of gelatin.

The 9th Layer: The first blue-sensitive emulsion layer ($BL_1$)

Silver iodobromide emulsion (silver iodide: 6% by mol), Amount of silver coated: 1.5 g/m$^2$

| | |
|---|---|
| Coupler Y-1 | 0.25 mol per mol of silver |

The 10th Layer: The second blue-sensitive emulsion layer ($BL_2$)

Silver iodobromide (silver iodide: 6% by mol), Amount of silver coated: 1.1 g/m$^2$

| | |
|---|---|
| Coupler Y-1 | 0.06 mol |

-continued per mol of silver

The 11th Layer: Protective Layer (PL)

A gelatin layer containing polymethyl methacrylate particles (particle size: about 1.5μ)

In addition to the above-described compositions, a gelatin hardener and a surface active agent were added to each layer.

Compounds used for preparing the samples:

Sensitizing Dye I: Anhydro-5,5'-dichloro-3,3'-di(γ-sulfopropyl)-9-ethylthiacarbocyanine hydroxide pyridinium salt.

Sensitizing Dye II: Anhydro-9-ethyl-3,3'-di(γ-sulfopropyl)-4,5,4',5'-dibenzothiacarbocyanine hydroxide triethylamine salt.

Sensitizing Dye III: Anhydro-9-ethyl-5,5'-dichloro-3,3'-di(γ-sulfopropyl)oxacarbocyanine sodium salt.

Sensitizing Dye IV: Anhydro-5,6,5',6'-tetrachloro-1,1'-diethyl-3,3'-di{β-[β-(γ-sulfopropoxy)ethoxy]ethyl}imidazolocarbocyanine hydroxide sodium salt.

Coupler A

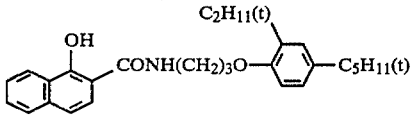

Coupler B

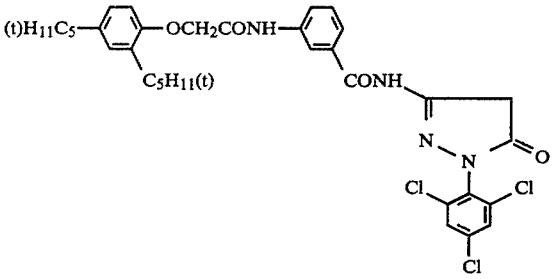

Coupler C-1

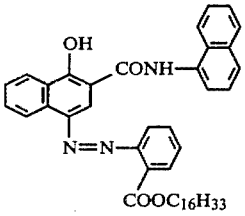

Coupler C-2

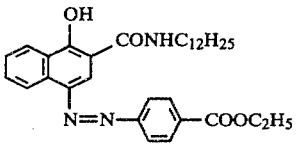

Coupler D

-continued

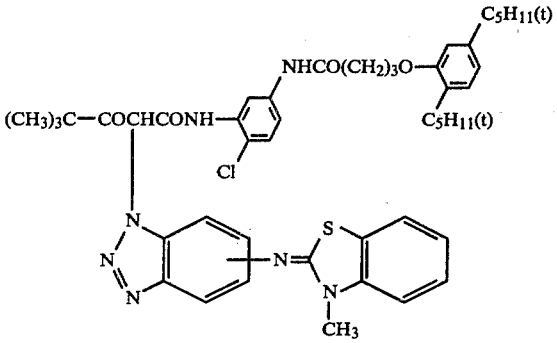

Coupler M-1

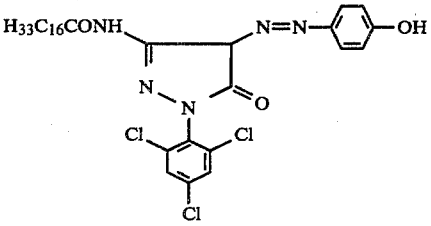

Coupler Y-1

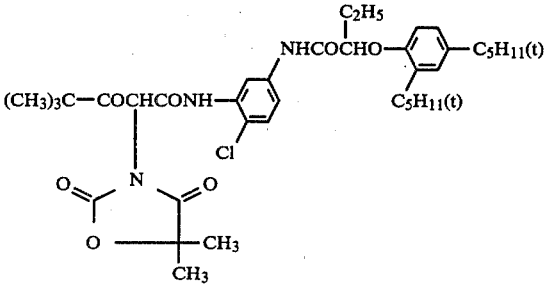

The above-described sample was designated Sample I. To the composition of the protective layer of Sample I, Emulsified Dispersions (A), (B), (C), (D) and (E) used in Example 1 were added and coated in a coating amount of 4.0 g/m$^2$, respectively, to prepare Samples II, III, IV, V and VI.

With respect to these samples, a film property, an anti-adhesive property and image sharpness were measured by the following methods, and results shown in Table 1 below were obtained.

(a) Film Property

After a strip of the sample was immersed in a color developing solution for processing CN-16 (manufactured by Fuji Photo Film Co., Ltd.) at 25° C. for 5 minutes, it was then scratched by means of a scratch strength tester equipped with a sapphire pin having a diameter of 0.1 mm to which a weight of 0 to 200 g was continuously applied, and film strength was examined by measuring the weight by which a scratch began to be made.

(b) Antiadhesion Test

A sample was cut in a size of 35 square mm. After the strips were conditioned for 1 day under a condition of 25° C. and 90% RH in such a state that each of them did not contact one another, they were preserved in such a state that the emulsion face was in contact with the back face under a condition of 40° C. and 90% RH for 2 days while applying a weight of 500 g. The films taken out were separated and the % area of the adhesion part was measured.

Valuations A to D are as follows:

A: Adhesion area 0–40%

B: 40–60%

C: 60–80%

(c) Image Sharpness

Image sharpness was determined by obtaining a response function (modulation transfer function; which is referred to as MTF, hereinafter) and comparing MTF values in a certain frequency. Measurement of MTF was carried out according to the method described in Masao Takano and Ikuo Fujimura, *Hihakaikensa,* Vol. 6, pages 472–482, (1967). Exposure was carried out using white light, and measurements in R, G and B layers were carried out through red, green and blue filters, respectively. Development was carried out using the following processings.

| | |
|---|---|
| 1. Color development | 3 minutes and 15 seconds |
| 2. Bleaching | 6 minutes and 30 seconds |
| 3. Washing with water | 3 minutes and 15 seconds |
| 4. Fixing | 6 minutes and 30 seconds |
| 5. Washing with water | 3 minutes and 15 seconds |
| 6. Stabilizing | 3 minutes and 15 seconds |

The compositions of the processing solutions used in each step were as follows.

Color Developing Solution:

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—α-hydroxyethylamino)-2-methylaniline sulfate | 4.5 g |
| Water to make | 1 l |
| Bleaching Solution: | |
| Ammonium bromide | 160.0 g |
| Aqueous ammonia solution (28%) | 25.0 ml |
| Sodium ethylenediaminetetraacetato iron complex | 130.0 g |
| Glacial acetic acid | 14.0 ml |
| Water to make | 1 l |
| Fixing Solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 l |
| Stabilizing Solution: | |
| Formalin | 8.0 ml |
| Water to make | 1 l |

In Table 1 below, MTF values in a frequency of 20 per mm are shown. A larger value means that the reproduction of fine parts of images is better, namely, image sharpness is higher.

TABLE 1

| Item Examined | Sample I (Blank) | II (This Invention) | III (This Invention) | IV (Comparison) | V (Comparison) | VI (Comparison) |
|---|---|---|---|---|---|---|
| Film Strength | 180 g | 171 g | 173 g | 41 g | 46 g | 52 g |
| Antiadhesion | A | A | A | C | C | C |
| MTF Value (%) | | | | | | |
| R | 75 | 74 | 73 | 69 | 68 | 68 |
| G | 83 | 82 | 81 | 74 | 73 | 74 |
| B | 90 | 88 | 89 | 80 | 80 | 81 |

It is apparent from the results shown in Table 1 that the photographic light-sensitive materials using the polymer ultraviolet ray absorbing agents according to the present invention Samples II and III are greatly improved in film strength and antiadhesive property as compared with Samples IV, V and VI, and they show excellent sharpness. Of course, since Sample I does not contain the ultraviolet ray absorbing agent, it cannot be practically used because it has very inferior properties such as color reproduction properties, as compared with Samples II and III.

EXAMPLE 3

In Examples 1 and 2, the ultraviolet ray absorbing polymer and the low molecular weight ultraviolet ray absorbing agent were coemulsified to prepare latexes. However, it is possible to add the ultraviolet ray absorbing agent directly to the protective layer as a latex prepared as described in Synthesis Examples III-1 and III-3.

Samples a, b and c were prepared by adding the latex prepared in Synthesis Example III-1, the latex prepared in Synthesis Example III-3 and a latex prepared by loading Compound (I-8) into a copolymer latex of Compound (2) described below and methyl methacrylate (1:1) in the same procedure as described in Synthesis Example III-1, same composition of the protective layer of Sample I in Example 2 into the same composition of the protective layer of Sample I in Example 2, respectively, and coating the resulting compositions on a cellulose triacetate support in a coating amount of 2.0 cc/m$^2$, 2.3 cc/m$^2$ and 2.3 cc/m$^2$, respectively.

Compound (2):

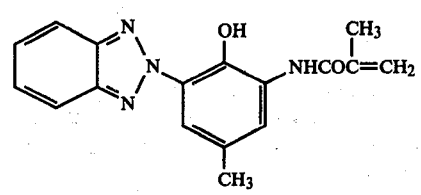

Figure 2:
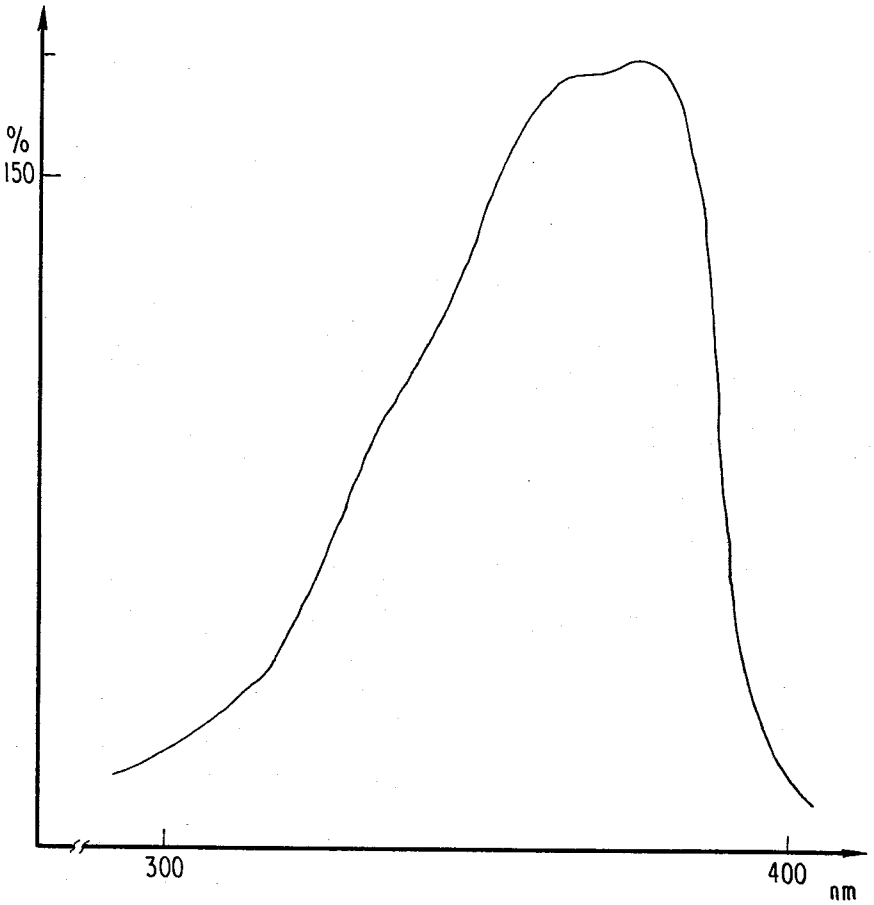
FIGS. 2 (a), (b) and (c) each indicates a spectral absorption curve, wherein the abscissa means absorption wavelength (unit: nm) and the ordinate means absorbance (%).

The spectral absorption characteristics of Samples a, b and c are shown in FIG. 2.

It is apparent from FIG. 2 that Samples a and b each has a sharp absorption characteristic in spite of containing the polymers. On the contrary, Sample c has low absorbance and has a broad absorption extending over a visible region.

Further, Sample I of the multilayer color photographic light-sensitive material in Example 2 and Samples VII, VIII and IX in which the protective layers of Samples a, b and c described above were used in place of the protective layer of Sample I, respectively, were compared.

Relative sensitivity of blue-sensitive layer, film strength, antiadhesion and MTF value with respect to these samples are shown in Table 2 below. With Sample I, exposure to light was carried out using white light in which UV rays of less than about 400 nm were cut by an ultraviolet ray absorbing filter.

TABLE 2

| Item Examined | Sample I (Blank) | VII (This Invention) | VIII (This Invention) | IX (Comparison) |
|---|---|---|---|---|
| Relative Sensitivity of Blue-Sensitive Layer (%) | 100 | 100 | 100 | 76 |
| Film Strength | 180 g | 174 g | 172 g | 172 g |
| Antiadhesion | A | A | A | A |
| MTF Value (%) | | | | |
| R | 75 | 74 | 73 | 73 |
| G | 83 | 82 | 80 | 80 |
| B | 90 | 89 | 88 | 86 |

It is apparent from the results shown in Table 2 that the sensitivity of the blue-sensitive layer in the visible region is not reduced in Samples VII and VIII, while it is remarkably reduced in Sample IX.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon a light-sensitive silver halide emulsion layer and a light-insensitive layer, the photographic light-sensitive material containing, in at least one layer selected from the light-sensitive silver halide emulsion layer and the light-insensitive layer, an ultraviolet ray absorbing polymer latex which comprises a homopolymer or a copolymer having a repeating unit derived from a monomer represented by the following general formula (II) in which at least one ultraviolet ray absorbing compound represented by the following general formula (I) is loaded:

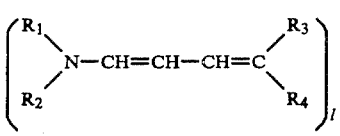

(I)

wherein l represents an integer of 1 or 2; $R_1$ and $R_2$, which may be the same or different, each represents a hydrogen atom, an alkyl group having from 1 to 20 carbon atoms or an aryl group having from 6 to 20 carbon atoms, provided that the both of $R_1$ and $R_2$ do not simultaneously represent hydrogen atoms, and further, $R_1$ and $R_2$ may combine to form an atomic group necessary to form a cyclic amino group; $R_3$ represents a cyano group, —$COOR_5$, —$COR_5$ or —$SO_2R_5$; and $R_4$ represents a cyano group, —$COOR_6$, —$COR_6$ or —$SO_2R_6$; wherein $R_5$ and $R_6$ each represents an alkyl group having from 1 to 20 carbon atoms or an aryl group having from 6 to 20 carbon atoms, and further $R_5$ and $R_6$ may combine to form an atomic group necessary to form a 1,3-dioxocyclohexane nucleus, a barbituric acid nucleus, a 1,2-diaza-3,5-dioxocyclopentane nucleus or a 2,4-diaza-1-alkoxy-3,5-dioxocyclohexene nucleus; and when l is 2, $R_1$, $R_2$ and $R_5$ each may further represent an alkylene group or an arylene group and at least one of $R_1$, $R_2$ and $R_5$ represents an alkylene group or an arylene group:

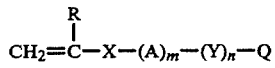

(II)

wherein R represents a hydrogen atom, a lower alkyl group having from 1 to 4 carbon atoms or a chlorine atom; X represents —CONH—, —COO— or a phenylene group; A represents a linking group selected from an alkylene group having from 1 to 20 carbon atoms or an arylene group having from 6 to 20 carbon atoms; Y represents —COO—, —OCO—, —CONH—, —NHCO—, —$SO_2$NH—, —NH$SO_2$—, —$SO_2$— or —O—; m represents 0 or an integer of 1; n represents 0 or an integer of 1; and Q represents an ultraviolet ray absorbing group represented by the following general formula (III):

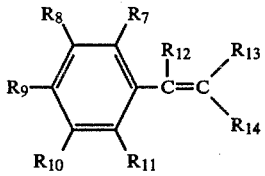

(III)

wherein $R_7$, $R_8$, $R_9$, $R_{10}$ and $R_{11}$, which may be the same or different, each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylthio group having from 1 to 20 carbon atoms, an arylthio group having from 6 to 20 carbon atoms, an amino group, an alkylamino group having from 1 to 20 carbon atoms, an arylamino group having from 6 to 20 carbon atoms, a hydroxyl group, a cyano group, a nitro group, an acylamino group, a carbamoyl group, a sulfonyl group, a sulfamoyl group, a sulfonamide group, an acyloxy group or an oxycarbonyl group, and $R_7$ and $R_8$, $R_8$ and $R_9$, $R_9$ and $R_{10}$ or $R_{10}$ and $R_{11}$ may form a 5- to 6-membered ring by ring closure; $R_{12}$ represents a hydrogen atom, an alkyl group having from 1 to 20 carbon atoms or an aryl group having from 6 to 20 carbon atoms; $R_{13}$ represents a cyano group, —$COOR_{15}$, —$CONHR_{15}$, —$COR_{15}$ or —$SO_2R_{15}$; $R_{14}$ represents a cyano group, —$COOR_{16}$, —$CONHR_{16}$, —$COR_{16}$ or —$SO_2R_{16}$; and $R_{15}$ and $R_{16}$ each represents an alkyl group having from 1 to 20 carbon atoms or an aryl group having from 6 to 20 carbon atoms; and at least one of $R_7$, $R_8$, $R_9$, $R_{10}$, $R_{11}$, $R_{12}$, $R_{13}$ and $R_{14}$ bonds to the vinyl group through the linking group.

2. A silver halide photographic light-sensitive material as claimed in claim 1, wherein l represents 1; $R_1$ and $R_2$ each represents an alkyl group having from 1 to 20 carbon atoms; $R_3$ represents a cyano group or —$SO_2R_5$; $R_4$ represents a cyano group or —$COOR_6$; and $R_5$ and $R_6$ each represents an alkyl group having from 1 to 20 carbon atoms or an aryl group having from 6 to 20 carbon atoms.

3. A silver halide photographic light-sensitive material as claimed in claim 1, wherein R represents a hydrogen atom, a lower alkyl group having from 1 to 4 carbon atoms or a chlorine atom; X represents —CONH—, —COO— or a phenylene group; A represents a linking group represented by an alkylene group having from 1 to 20 carbon atoms or an arylene group having from 6 to 20 carbon atoms; Y represents —COO—, —OCO—, —CONH—, —NHCO— or —O—; m represents 0 or an integer of 1; n represents 0 or an integer of 1; and Q represents an ultraviolet ray absorbing group represented by the general formula (III) wherein $R_7$, $R_8$, $R_9$, $R_{10}$ and $R_{11}$ each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylamino group having from 1 to 20 carbon atoms, an arylamino group having from 6 to 20 carbon atoms, a hydroxy group, an acylamino group, a carbamoyl group, an acyloxy group or an oxycarbonyl group, and $R_7$ and $R_8$, $R_8$ and $R_9$, $R_9$ and $R_{10}$ or $R_{10}$ and $R_{11}$ may form a 5- or 6-membered ring by ring closure; $R_{12}$ represents a hydrogen atom or an alkyl group having from 1 to 20 carbon atoms; $R_{13}$ represents a cyano group, —$COOR_{15}$, —$CONHR_{15}$, —$COR_{15}$ or —$SO_2R_{15}$; $R_{14}$ represents a cyano group, —$COOR_{16}$, —$CONHR_{16}$, —$COR_{16}$ or —$SO_2R_{16}$; and $R_{15}$ and $R_{16}$ each represents an alkyl group having from 1 to 20 carbon atoms or an aryl group having from 6 to 20 carbon atoms; wherein at least one of $R_7$, $R_8$, $R_9$, $R_{10}$, $R_{11}$, $R_{12}$, $R_{13}$ and $R_{14}$ bonds to the vinyl group through the linking group.

4. A silver halide photographic light-sensitive material as claimed in claim 1, wherein l represents 1; $R_1$ and $R_2$ each represents an alkyl group having from 1 to 6 carbon atoms; $R_3$ represents —$SO_2R_5$; $R_4$ represents —$COOR_6$; $R_5$ represents a phenyl group which may be substituted; and $R_6$ represents an alkyl group having from 1 to 20 carbon atoms.

5. A silver halide photographic light-sensitive material as claimed in claim 1, wherein R represents a hydrogen atom, a lower alkyl group having from 1 to 4 carbon atoms or a chlorine atom; X represents —COO—; m represents 0; n represents 0; and Q represents an ultraviolet ray absorbing group represented by the general formula (III) wherein $R_7$, $R_8$, $R_{10}$ and $R_{11}$ each represents a hydrogen atom; $R_9$ represents a hydrogen atom or an alkyl group having from 1 to 5 carbon atoms; $R_{12}$ represents a hydrogen atom; $R_{13}$ represents a cyano group; $R_{14}$ represents —$COOR_{16}$; and $R_{16}$ represents an alkylene group having from 1 to 20 carbon atoms which bonds to the vinyl group.

6. A silver halide photographic light-sensitive material as claimed in claim 1, wherein the ultraviolet ray absorbing polymer latex comprises a homopolymer having a repeating unit derived from the monomer represented by the general formula (II).

7. A silver halide photographic light-sensitive material as claimed in claim 1, wherein the ultraviolet ray absorbing polymer latex comprises a copolymer of the monomer represented by the general formula (II) with a copolymerizable monomer.

8. A silver halide photographic light-sensitive material as claimed in claim 7, wherein the copolymerizable monomer is selected from the group consisting of an acrylic acid ester, an acrylic acid amide, a vinyl ester, an acrylonitrile, an aromatic vinyl compound, itaconic acid, citraconic acid, crotonic acid, vinylidene chloride, a vinyl alkyl ether, a maleic acid ester, N-vinylpyrrolidone, N-vinylpyridine, and 2- or 4-vinylpyridine.

9. A silver halide photographic light-sensitive material as claimed in claim 7, wherein the copolymerizable monomer is an acrylic acid ester, a methacrylic acid ester or an aromatic vinyl compound.

10. A silver halide photogrpahic light-sensitive material as claimed in claim 1, wherein the ultraviolet ray absorbing polymer latex is a latex prepared by emulsion polymerization of monomers comprising the monomer represented by the general formula (II).

11. A silver halide photographic light-sensitive material as claimed in claim 1, wherein the ultraviolet ray absorbing polymer latex is a latex prepared by dissolving a hydrophobic polymer ultraviolet ray absorbing agent obtained by polymerization of monomers comprising the monomer represented by the general formula (II) in an organic solvent and then dispersing the solution in a latex form in an aqueous gelatin solution.

12. A silver halide photographic light-sensitive material as claimed in claim 1, wherein the amount of the ultraviolet ray absorbing group, represented by Q, in the ultraviolet ray absorbing polymer latex is from 5 to 100% by weight.

13. A silver halide photographic light-sensitive material as claimed in claim 1, wherein the amount of the ultraviolet ray absorbing group, represented by Q, in the ultraviolet ray absorbing polymer latex is from 50 to 100% by weight.

14. A silver halide photographic light-sensitive material as claimed in claim 1, wherein the ultraviolet ray absorbing polymer latex in which an ultraviolet ray absorbing compound represented by the general formula (I) is loaded is a latex prepared by loading the compound represented by the general formula (I) into the ultraviolet ray absorbing polymer latex having a repeating unit derived from a monomer represented by the general formula (II).

15. A silver halide photographic light-sensitive material as claimed in claim 1, wherein the ultraviolet ray absorbing polymer latex in which the ultraviolet ray absorbing compound represented by the general formula (I) is loaded is a latex prepared by dissolving an ultraviolet ray absorbing polymer having a repeating unit derived from a monomer represented by the general formula (II) and an ultraviolet ray absorbing compound represented by the general formula (I) in an organic solvent having a low boiling point and then emulsifying the solution in an aqueous phase.

16. A silver halide photographic light-sensitive material as claimed in claim 1, wherein the ultraviolet ray absorbing compound represented by the general formula (I) is present in an amount within the range from 50% to 300% by weight based on the amount of the polymer having a repeating unit derived from a monomer represented by the general formula (II).

17. A silver halide photographic light-sensitive material as claimed in claim 1, wherein the ultraviolet ray absorbing compound represented by the general formula (I) is present in an amount within the range from 100% to 200% by weight based on the amount of the polymer having a repeating unit derived from a monomer represented by the general formula (II).

18. A silver halide photographic light-sensitive material as claimed in claim 1, wherein the ultraviolet ray absorbing polymer latex is present in a surface protective layer, an intermediate layer or a silver halide emulsion layer.

19. A silver halide photographic light-sensitive material as claimed in claim 1, wherein the ultraviolet ray absorbing polymer latex is present in a surface protective layer or a hydrophilic colloid layer adjacent to the surface protective layer.

20. A silver halide photographic light-sensitive material as claimed in claim 19, wherein the surface protective layer is composed of two separate layers and the lower layer thereof contains the ultraviolet ray absorbing polymer latex.

21. A silver halide photographic light-sensitive material as claimed in claim 1, wherein the ultraviolet ray absorbing polymer latex is present in an amount within the range of 10 to 2,000 mg/m$^2$ of the material.

22. A silver halide photographic light-sensitive material as claimed in claim 1, wherein the ultraviolet ray absorbing polymer latex is present in an amount within the range of 50 to 1,000 mg/m$^2$ of the material.

23. A multilayer color photographic light-sensitive material comprising a support having thereon a red-sensitive silver halide emulsion layer containing a cyan forming coupler, a green-sensitive silver halide emulsion layer containing a magenta forming coupler, a blue-sensitive silver halide emulsion layer containing a yellow coupler and a surface protective layer containing an ultraviolet ray absorbing polymer latex which comprises a homopolymer or a copolymer having a repeating unit derived from a monomer represented by the following general formula (II) in which an ultraviolet ray absorbing compound represented by the following general formula (I) is loaded:

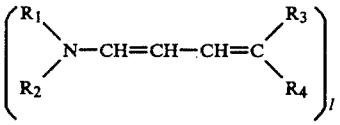

(I)

wherein l represents an integer of 1 or 2; $R_1$ and $R_2$, which may be the same or different, each represents a hydrogen atom, an alkyl group having from 1 to 20 carbon atoms or an aryl group having from 6 to 20 carbon atoms, provided that the both of $R_1$ and $R_2$ do not simultaneously represent hydrogen atoms, and further $R_1$ and $R_2$ may combine to form an atomic group necessary to form a cyclic amino group; $R_3$ represents a cyano group, —$COOR_5$, —$COR_5$ or —$SO_2R_5$; and $R_4$ represents a cyano group, —$COOR_6$, —$COR_6$ or —$SO_2R_6$; wherein $R_5$ and $R_6$ each represents an alkyl group having from 1 to 20 carbon atoms or an aryl group having from 6 to 20 carbon atoms, and further $R_5$ and $R_6$ may combine to form an atomic group necessary to form a 1,3-dioxocyclohexane nucleus, a barbituric acid nucleus, a 1,2-diaza-3,5-dioxocyclopentane nucleus or a 2,4-diaza-1-alkoxy-3,5-dioxocyclohexene nucleus; and when l is 2, $R_1$, $R_2$ and $R_5$ each may further represent an alkylene group or an arylene group and at least one of $R_1$, $R_2$ and $R_5$ represents an alkylene group or an arylene group:

$$CH_2{=}\overset{\overset{\displaystyle R}{|}}{C}{-}X{-}(A)_m{-}(Y)_n{-}Q \qquad \text{(II)}$$

wherein R represents a hydrogen atom, a lower alkyl group having from 1 to 4 carbon atoms or a chlorine atom; X represents —CONH—, —COO— or a phenylene group; A represents a linking group selected from an alkylene group having from 1 to 20 carbon atoms and an arylene group having from 6 to 20 carbon atoms; Y represents —COO—, —OCO—, —CONH—, —NHCO—, —$SO_2$NH—, —NH$SO_2$—, —$SO_2$— or —O—; m represents 0 or an integer of 1; n represents 0 or an integer of 1; and Q represents an ultraviolet ray absorbing group represented by the following general formula (III):

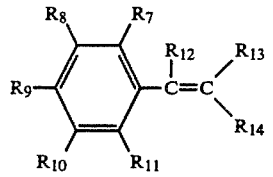

(III)

wherein $R_7$, $R_8$, $R_9$, $R_{10}$ and $R_{11}$, which may be the same or different, each represents a hydrogen atom, a halogen atom, an alkyl group having from 1 to 20 carbon atoms, an aryl group having from 6 to 20 carbon atoms, an alkoxy group having from 1 to 20 carbon atoms, an aryloxy group having from 6 to 20 carbon atoms, an alkylthio group having from 1 to 20 carbon atoms, an arylthio group having from 6 to 20 carbon atoms, an amine group, an alkylamino group having from 1 to 20 carbon atoms, an arylamino group having from 6 to 20 carbon atoms, a hydroxyl group, a cyano group, a nitro group, an acylamino group, a carbamoyl group, a sulfonyl group, a sulfamoyl group, a sulfonamide group, an acyloxy group or an oxycarbonyl group, and $R_7$ and $R_8$, $R_8$ and $R_9$, $R_9$ and $R_{10}$ or $R_{10}$ and $R_{11}$ may form a 5- to 6-membered ring by ring closure; $R_{12}$ represents a hydrogen atom, an alkyl group having from 1 to 20 carbon atoms or an aryl group having from 6 to 20 carbon atoms; $R_{13}$ represents a cyano group, —$COOR_{15}$, —$CONHR_{15}$, —$COR_{15}$ or —$SO_2R_{15}$; $R_{14}$ represents a cyano group, —$COOR_{16}$, —$CONHR_{16}$, —$COR_{16}$ or —$SO_2R_{16}$; and $R_{15}$ and $R_{16}$ each represents an alkyl group having from 1 to 20 carbon atoms or an aryl group having from 6 to 20 carbon atoms; and at least one of $R_7$, $R_8$, $R_9$, $R_{10}$, $R_{11}$, $R_{12}$, $R_{13}$ and $R_{14}$ bonds to the vinyl group through the linking group.

24. A silver halide photographic light-sensitive material as claimed in claim 1, wherein the compound represented by the general formula (I) is present within the light-sensitive silver halide emulsion layer.

25. A silver halide photographic light-sensitive material as claimed in claim 1, wherein the compound represented by the general formula (I) is present within the light-insensitive layer.

26. A silver halide photographic light-sensitive material as claimed in claim 1, wherein the material is further comprised of a surface protective layer and wherein the ultraviolet ray absorbing polymer latex is present in the surface protective layer.

27. A silver halide photographic light-sensitive material as claimed in claim 1, wherein the material is further comprised of a hydrophilic colloid layer and a surface protective layer adjacent to the hydrophilic colloid layer and further wherein the ultraviolet ray absorbing polymer latex is present within the hydrophilic colloid layer.

28. A silver halide photographic light-sensitive material as claimed in claim 1, wherein the material is further comprised of a surface protective layer comprised of two separate layers and wherein the upper layer of the two layers contains the ultraviolet ray absorbing polymer latex.

* * * * *